US009654857B2

(12) United States Patent
Park et al.

(10) Patent No.: US 9,654,857 B2
(45) Date of Patent: May 16, 2017

(54) MOBILE TERMINAL

(71) Applicant: LG ELECTRONICS INC., Seoul (KR)

(72) Inventors: Sihwa Park, Seoul (KR); Yongsin Kim, Seoul (KR); Jongho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 186 days.

(21) Appl. No.: 14/500,430

(22) Filed: Sep. 29, 2014

(65) Prior Publication Data

US 2015/0312666 A1 Oct. 29, 2015

(30) Foreign Application Priority Data

Apr. 23, 2014 (KR) ..... 10-2014-0048560

(51) Int. Cl.
*H04R 1/10* (2006.01)

(52) U.S. Cl.
CPC ..... *H04R 1/1025* (2013.01); *H04R 1/1041* (2013.01); *H04R 2420/05* (2013.01)

(58) Field of Classification Search
CPC ..... H04R 1/1041; H04R 1/1025; H04R 1/10; H04R 25/602; H04B 1/3883; H04B 1/1615; H04B 1/38; H04M 19/08; H04M 1/60; H04M 1/02; H04M 1/03; H04M 1/21; H04M 1/62; H04W 52/028; H04W 52/02; H04W 52/0225; H04W 52/0229; H01M 8/02; H01M 8/10; H01M 10/058; H01M 2/10; H01M 4/66; H01M 4/36; H02J 3/38; H02J 9/04; H02J 7/0008; H02J 7/0011; H02J 7/0013; H02J 7/0014; H02J 7/0016; H02J 7/0018; H02J 7/0019; H02J 7/0024; Y10T 307/696
USPC ..... 381/74, 72, 73.1, 309, 323; 700/94; 455/573; 429/94, 90; 379/102.04, 379/106.04, 307, 322, 348, 395.01, 413; 320/117, 119, 120, 121, 122; 307/80
See application file for complete search history.

(56) References Cited

U.S. PATENT DOCUMENTS

| | | | | |
|---|---|---|---|---|
| 2007/0281756 A1* | 12/2007 | Hyatt | ..... | H02J 7/0042 455/573 |
| 2008/0315826 A1* | 12/2008 | Alberth, Jr. | ..... | H02J 7/0013 320/101 |
| 2011/0170703 A1 | 7/2011 | Palma | | |
| 2011/0274954 A1 | 11/2011 | Cho et al. | | |

FOREIGN PATENT DOCUMENTS

| | | | | |
|---|---|---|---|---|
| JP | 2001110244 A * | 4/2001 | ..... | H01B 7/00 |
| KR | 10-2010-0077692 A | 7/2010 | | |
| KR | 10-2010-0081889 A | 7/2010 | | |
| WO | WO 2009/059181 A2 | 5/2009 | | |
| WO | WO 2013/042939 A2 | 3/2013 | | |

* cited by examiner

*Primary Examiner* — Leshui Zhang
(74) *Attorney, Agent, or Firm* — Birch, Stewart, Kolasch & Birch, LLP

(57) ABSTRACT

A mobile terminal according to the present invention, if it is determined that external power is being supplied through an external charging port, a controller controls the power supply unit to charge the cable-type battery by using the external power. If it is determined that the external power is not supplied, the controller controls the power supply unit to charge the main battery by using a cable-type battery embedded in an earphone.

8 Claims, 39 Drawing Sheets

(a) Case Ⅰ:Single use of main battery (b) Case Ⅱ:Single use of cable-type battery (c) Case Ⅲ:Simultaneous use of main battery and cable-type battery

MOBILE TERMINAL

CROSS-REFERENCE TO RELATED APPLICATIONS

This application claims priority to Korean Patent Application No. 10-2014-0048560 filed on 23 Apr. 2014 in Korea, the entire contents of which is hereby incorporated by reference in its entirety.

BACKGROUND OF THE INVENTION

Field of the Invention

The present invention relates to a mobile terminal.

Related Art

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

Efforts are ongoing to support and increase the functionality of mobile terminals. Such efforts include software and hardware improvements, as well as changes and improvements in the structural components.

Meanwhile, the mobile terminal is a portable device receiving power through a detachable battery. A secondary battery can be used for the portable terminal. Secondary batteries of today are used for the applications requiring low power consumption. Example applications of the secondary battery include car ignition devices, portable devices, gadgets, and uninterruptable power supplies.

Demand for secondary batteries is growing fast due to the recent advancement of wireless communication technology. In most cases, secondary batteries are fabricated in a cylinder shape, square shape, or pouch shape. This variety of battery shape is ascribed to the fact that secondary batteries are fabricated by installing an electrode assembly consisting of cathode, anode, and membrane inside a metal can of cylinder or square shape or inside a pouch-type case made of aluminum laminate sheet, and injecting electrolyte into the electrode assembly. Therefore, since separate space for secondary battery is necessary, the secondary battery limited to the shape of a cylinder, square, or pouch may become an obstacle for development of portable devices of various shapes. In this regard, there is growing demand for a new type of secondary battery whose shape can be easily changed so that the secondary battery can be applied to portable terminals in various ways.

SUMMARY OF THE INVENTION

Accordingly, an object of the present invention is to address the above-noted and other problems.

An object of the present invention is to provide a mobile terminal capable of charging a main battery by using an earphone with a cable-type battery or capable of charging a cable-type battery of an earphone by using the main battery or external power.

Another object of the present invention is to provide a mobile terminal capable of providing information related to charging a main battery or cable-type battery based on a user's operation on an earphone cable with a cable-type battery or capable of controlling a charging operation.

A mobile terminal according to one aspect of the present invention comprises a power supply unit including a rechargeable main battery; an earphone port; and a controller determining whether an earphone with a cable-type battery is connected through the earphone port and external power for charging the main battery is supplied, controlling the power supply unit to charge the main battery by using the external power if it is determined that the external power is being supplied, and controlling the power supply unit to charge the main battery by using the cable-type battery embedded in the earphone if it is determined that the earphone is connected through the earphone port while the external power is not supplied.

The controller, if the earphone is connected, determines whether the external power is supplied; and controls the power supply unit to charge the main battery by using the external power if the earphone is connected while the external power is being supplied and to charge the main battery by using the cable-type battery embedded in the earphone if the earphone is connected while the external power is not supplied.

If the external power is supplied, the controller controls the power supply unit so that the external power can charge the main battery regardless of whether the earphone is connected or not.

The external power can be supplied through a charging cable connected to a charging port or can be supplied from the outside according to a predetermined wireless charging method.

If it is determined that the external power is being supplied at the time the earphone is connected, the controller can further control the power supply unit to charge the cable-type battery by using the external power.

The controller can determine charging priorities of the main battery and the cable-type battery and control the power supply unit to charge the main battery and the cable-type battery according to the priorities determined.

The mobile terminal can further comprise a display unit. At this time, the controller can display on the display unit a graphic user interface meant for setting up charging priorities of the main battery and the cable-type battery if it is determined that the external power is being supplied at the time the earphone is connected and control the power supply unit to charge the main battery and the cable-type battery according to the priorities set up through the graphic user interface.

In case the external power is not supplied at the time the earphone is connected, the controller can determine whether to charge the main battery by using the cable-type battery by taking account of the remaining battery life.

In case it is determined that the external power is not supplied at the time the earphone is connected and a predetermined condition met, the controller can control the power supply unit to operate the mobile terminal by using the cable-type battery as a power source rather than using the cable-type battery to charge the main battery.

In case supply of external power through the external charging port is suspended after the earphone is connected, the controller can control the power supply unit to charge the main battery by using the cable-type battery.

In case the main battery is removed from the mobile terminal after the earphone is connected, the controller can control the power supply unit to operate the mobile terminal by using the cable-type battery as a power source.

The earphone comprises a sensing means installed in part of the cable meant for sensing a user's operation; and the controller can control an output unit to provide information related to charging the main battery and the cable-type battery based on the user's operation on the earphone cable sensed by the sensing means or control a charging operation on the main battery and the cable-type battery.

The controller can control an output unit of the mobile terminal based on a position of the user's operation with respect to the earphone cable to provide remaining capacity information of the cable-type battery.

The controller can control the power supply unit to charge the main battery by using the cable-type battery based on a direction of the user's operation with respect to the earphone cable; or to charge the cable-type battery by using the external power or the main battery.

The controller can control a charging speed of the main battery and the cable-type battery based on the number of the user's operation or an operation speed with respect to the earphone cable.

The controller can control an operation state of the mobile terminal based on the user's operation with respect to the earphone cable. For example, the controller can control the sound volume of the mobile terminal based on the position and direction of the user's operation with respect to the earphone cable.

The controller can control an execution state of an application under execution in the mobile terminal based on the position and direction of the user's operation with respect to the earphone cable.

A mobile terminal according to another aspect of the present invention comprises a power supply unit including a main battery which can be charged by external power; an earphone port to which connected is an earphone including a cable-type battery which can be used for charging the main battery or as an independent power source and a sensing means installed in part of the cable meant for sensing a user's operation; and a controller controlling the power supply unit to charge the main battery by using the cable-type battery based on the user's operation with respect to the earphone cable or to charge the cable-type battery by using the external power or the main battery. The external power can be supplied through a charging cable connected to a charging port or derived from a wireless charging signal supplied from the outside according to a predetermined wireless charging method.

The controller, based on a position or a direction of the user's operation with respect to the earphone cable, can control the power supply unit to charge the main battery by using the cable-type battery or to charge the cable-type battery by using the external power or the main battery.

The controller can control a charging speed of the main battery or the cable-type battery based on the number or a speed of the user's operation with respect to the earphone cable.

The controller can provide information related to charging the main battery and the cable-type battery based on the user's operation with respect to the earphone cable. For example, the controller can provide remaining capacity information of the cable-type battery based on a position of the user's operation with respect to the earphone cable.

The controller can control the operation state of the mobile terminal based on the user's operation with respect to the earphone cable. For example, the controller can control the sound volume of the mobile terminal based on a position and a direction of the user's operation with respect to the earphone cable.

The controller can control an execution state of an application under execution in the mobile terminal based on a position and a direction of the user's operation with respect to the earphone cable.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 23 is an example providing information of remaining capacity of a cable-type battery embedded in an earphone according to a method for operating a mobile terminal of FIG. 27;

DESCRIPTION OF EXEMPLARY EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Examples of a mobile terminal described in this document may include cellular phones, smart phones, laptop computers, digital broadcast terminals, personal digital assistants (PDAs), portable multimedia players (PMPs), navigation devices, slate PCs, tablet PCs, ultrabooks, and wearable devices (for example, smart watches, smart glasses, and head mounted displays (HMDs)).

Except for the part dedicated to a mobile terminal, the structure according to an embodiment of the present invention can be applied equally to other types of terminals such as a digital TV, a desktop computer, and digital signage, which should be understood easily by those skilled in the art.

Figure 1:
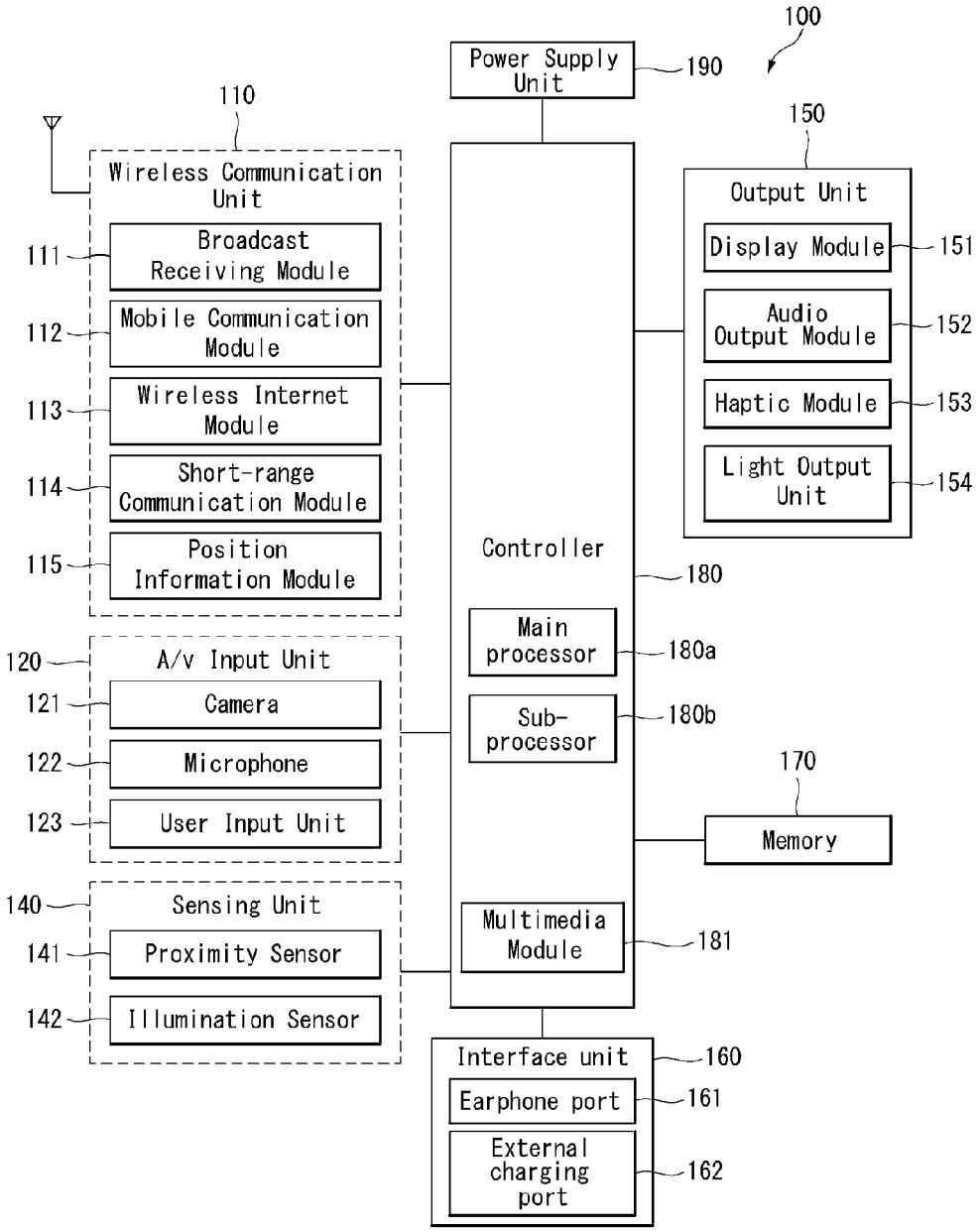
FIG. 1 is a block diagram of a mobile terminal in accordance with the present disclosure.
Figure 2:
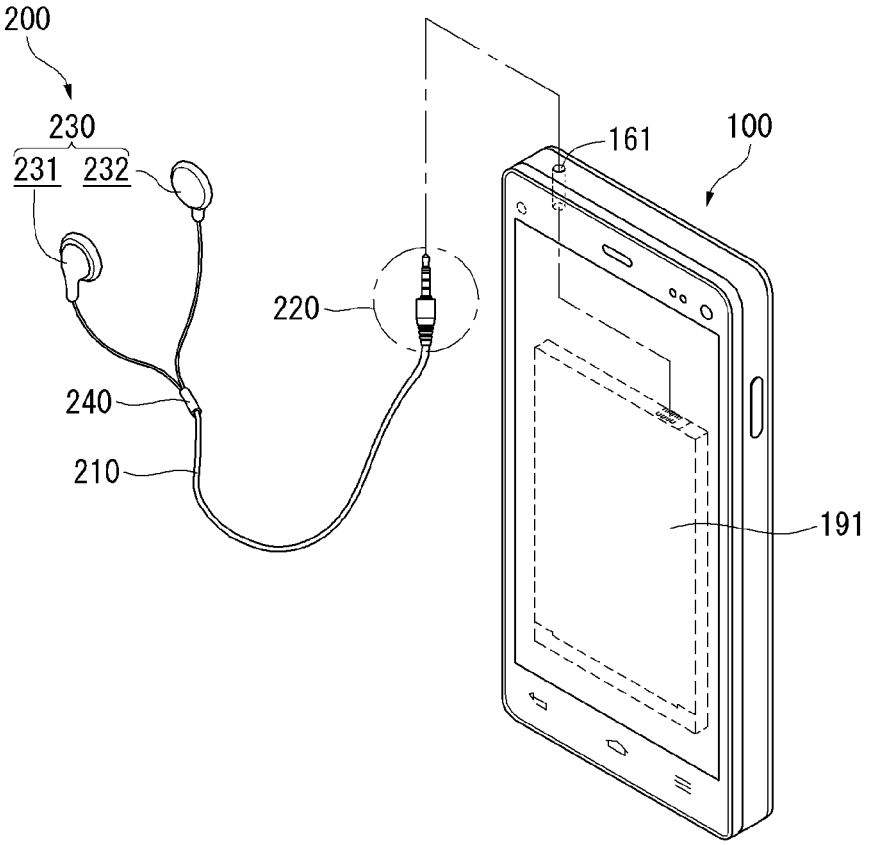
FIGS. 2 and 3 are conceptual views of one example of the mobile terminal, viewed from different directions.
Figure 3:
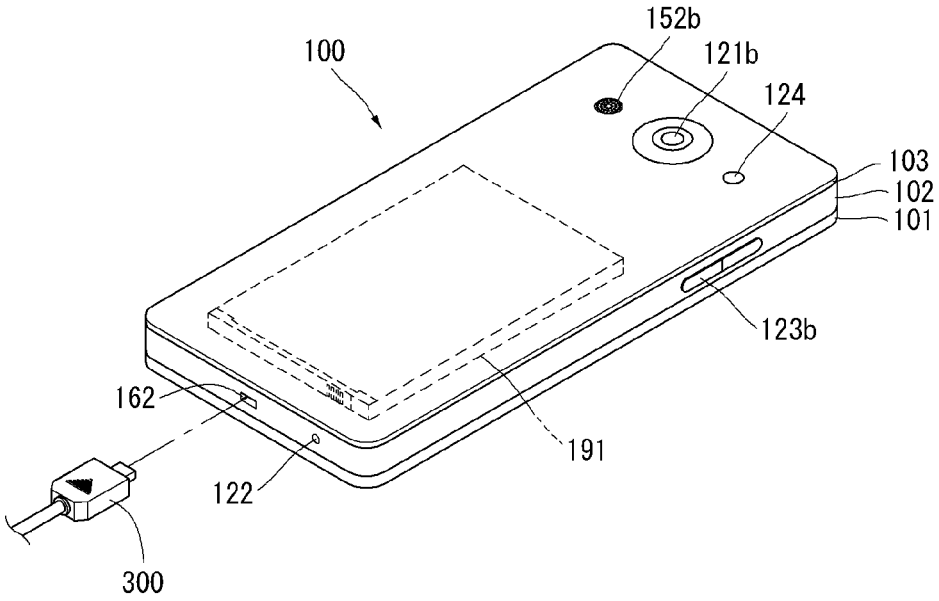

Reference is now made to FIGS. 1-3, where FIG. 1 is a block diagram of a mobile terminal according to the present invention, and FIGS. 2 and 3 are conceptual views of one example of the mobile terminal, viewed from different directions.

The mobile terminal 100 can comprise a wireless communication unit 110, an input unit 120, a sensing unit 140, an output unit 150, an interface unit 160, a memory 170, a controller 180, and a power supply unit 190. It should be understood that implementing all of the illustrated components is not a mandatory requirement, and that a greater or a fewer number of components than are listed above may alternatively be implemented.

More specifically, the wireless communication unit 110 can include one or more components which support wireless communication between the mobile terminal 100 and a wireless communication system, wireless communication between the mobile terminal 100 and another mobile terminal 100; or wireless communication between the mobile terminal 100 and an external server. Also, the wireless communication unit 100 can include one or more modules connecting the mobile terminal 100 to more than one network.

The wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio sound, and a user input unit 123 (for example, a touch key, a mechanical key, and the like) for allowing a user to input information. Audio or image data collected by the input unit 120 can be analyzed to be used as a control command of the user.

The sensing unit 140 is typically implemented using one or more sensors configured to sense internal information of the mobile terminal, the surrounding environment of the mobile terminal, user information, and the like. For example, the sensing unit 140 can include at least one of a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like). Meanwhile, the mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, and tactile output. The output unit 150 can include at least one of a display unit 151, an audio output module 152, a haptic module 153, and an optical output module 154. The display unit 151 may have an inter-layered structure or an integrated structure with a touch sensor in order to implement a touch screen. The touch screen may provide an output interface between the mobile terminal 100 and a user, as well as function as the user input unit 123 which provides an input interface between the mobile terminal 100 and the user.

The interface unit 160 serves as an interface for various types of external devices that can be coupled to the mobile terminal 100. The interface unit 160, for example, may include any of a wired or wireless port, an external power supply port, a wired or wireless data port, a memory card port, a port for connecting a device having an identification module, an audio input/output (I/O) port, a video I/O port, and an earphone ports 161. In some cases, the mobile terminal 100 may perform an appropriate control functions associated with an external device according as the external device is connected to the interface unit 160. For the purpose of description of the present invention, a separate reference symbol is assigned to the earphone port 161 and an external charging port 162.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically controls an overall operation of the mobile terminal 100, in addition to the operations associated with the application programs. The controller 180 may provide appropriate information for the user or process functions by processing signals, data, information and the like, which are input or output through the various components depicted in FIG. 1, or activating application programs stored in the memory 170.

Also, the controller 180 can control at least part of the components depicted in FIG. 1 to activate application programs stored in the memory 170. Further, the controller 180 can combine at least two or more components from among the components included in the mobile terminal 100 and operate them together to activate the application programs.

A mobile terminal 100 according to one embodiment of the present invention can comprise a main processor **180*a* and a sub-processor 180*b*. The main processor 180*a* can control the operation of each constituting element during operation of the mobile terminal 100 by supplying power to constituting elements of the mobile terminal 100 of FIG. 1 through the power supply unit 190. Meanwhile, the sub-processor 180*b* can activate only the audio output function from the mobile terminal 100 when an earphone with a cable-type battery is inserted into the earphone port 161 while the mobile terminal 100 is turned off. The sub-processor 180*b* can be driven by stand-by power while the mobile terminal 100 is turned off. It is assumed in FIG. 1 that the main processor 180*a* and the sub-processor 180*b* are included in the controller 180, but in other embodiments of the present invention, the main processor 180*a* and the sub-processor 180*b* can be implemented by hardware components separately from the controller of the mobile terminal 100**.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body. Meanwhile, according to one embodiment of the present invention, in case an earphone with a cable-type battery is inserted into the earphone port 161, the controller 180 can control the mobile terminal 100 so that various charging functions employing the cable-type battery can be carried out. And the controller 180 can control the various charging functions based on the user's operation on the earphone cable with a sensing means carrying out a function of sensing the user's operation thereon.

At least part of the constituting elements can operate in harmony with each other to implement an operation or a control method of the mobile terminal according to various embodiments described below. Also, the operation or the control method of the mobile terminal can be implemented in the mobile terminal by activating at least one application program stored in the memory 170.

Referring now to FIGS. 2 and 3, the mobile terminal 100 is described with reference to a bar-type terminal body. However, the mobile terminal 100 may alternatively be implemented in any of a variety of different configurations. Examples of such configurations include watch-type, clip-type, glasses-type, or as a folder-type, flip-type, slide-type, swing-type, and swivel-type in which two and more bodies are combined with each other in a relatively movable manner, and combinations thereof. Discussion herein will often relate to a particular type of mobile terminal (for example, bar-type, watch-type, glasses-type, and the like).

However, such teachings with regard to a particular type of mobile terminal will generally apply to other types of mobile terminals as well.

Here, a terminal body can be understood as a concept of indicating the mobile terminal as a whole.

With reference to FIG. 2, the mobile terminal 100 can comprise an earphone port 161 on one side of the mobile terminal 100, into which a plug 220 of an earphone 200 is inserted. The mobile terminal 100 can transmit an audio sound to the earphone 200 through the earphone port 161 and receive a voice signal from the earphone 200. The earphone port 161 can be formed on a upper surface of the case of the mobile terminal 100.

Meanwhile, according to one embodiment of the present invention, the mobile terminal 100 can use the earphone 200 as an auxiliary battery and receive power from the earphone 200 to operate the mobile terminal 100.

The earphone 200 can connect a plug 220, a speaker 230, a microphone 240, and the constituting elements together and comprise an earphone cable 210 with a cable-type battery.

The plug 220 is connected to the earphone port 161 of the mobile terminal 100. The speaker 230 can comprise a left speaker 231 outputting a left audio sound and a right speaker 231 outputting a right audio sound 240. The microphone can transmit a received voice signal to the mobile terminal 100.

Meanwhile, according to one embodiment of the present invention, the earphone 200 can be inserted into the earphone port 161 to charge the power supply unit 191 through the cable-type battery embedded in the earphone. In this document, the battery included in the power supply unit 190 is called a main battery.

The cable-type battery can directly charge a battery detachable from the mobile terminal 100, or carry out a predetermined function by supplying power directly to at least part of constituting elements of the mobile terminal 100.

The mobile terminal 100 will generally include a case (for example, frame, housing, cover, and the like) forming the appearance of the terminal. In this embodiment, the case is formed using a front case 101 and a rear case 102. Various electronic components are incorporated into a space formed between the front case 101 and the rear case 102. At least one middle case may be additionally positioned between the front case 101 and the rear case 102.

The display unit 151 is shown located on the front side of the terminal body to output information. As illustrated, a window 151*a* of the display unit 151 may be mounted to the front case 101 to form the front surface of the terminal body together with the front case 101.

In some embodiments, electronic components may also be mounted to the rear case 102. Examples of such electronic components include a detachable battery 191, an identification module, a memory card, and the like. Rear cover 103 is shown covering the electronic components, and this cover may be detachably coupled to the rear case 102. Therefore, when the rear cover 103 is detached from the rear case 102, the electronic components mounted to the rear case 102 are externally exposed.

As illustrated, when the rear cover 103 is coupled to the rear case 102, a side surface of the rear case 102 is partially exposed. In some cases, upon the coupling, the rear case 102 may also be completely shielded by the rear cover 103. In some embodiments, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), aluminum (Al), titanium (Ti), or the like.

As an alternative to the example in which the plurality of cases form an inner space for accommodating components, the mobile terminal 100 may be configured such that one case forms the inner space. In this example, a mobile terminal 100 having a uni-body is formed in such a manner that synthetic resin or metal extends from a side surface to a rear surface.

If desired, the mobile terminal 100 may include a waterproofing unit (not shown) for preventing introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

FIGS. 2 and 3 depict certain components as arranged on the mobile terminal. However, it is to be understood that alternative arrangements are possible and within the teachings of the instant disclosure. Some components may be omitted or rearranged. For example, the first manipulation unit 123*a* may be located on another surface of the terminal body, and the second audio output module 152*b* may be located on the side surface of the terminal body.

The display unit 151 outputs information processed in the mobile terminal 100. The display unit 151 may be implemented using one or more suitable display devices. Examples of such suitable display devices include a liquid crystal display (LCD), a thin film transistor-liquid crystal display (TFT-LCD), an organic light emitting diode (OLED), a flexible display, a 3-dimensional (3D) display, an e-ink display, and combinations thereof.

The display unit 151 may be implemented using two display devices, which can implement the same or different display technology. For instance, a plurality of the display units 151 may be arranged on one side, either spaced apart from each other, or these devices may be integrated, or these devices may be arranged on different surfaces.

The display unit 151 may also include a touch sensor which senses a touch input received at the display unit. When a touch is input to the display unit 151, the touch sensor may be configured to sense this touch and the controller 180, for example, may generate a control command or other signal corresponding to the touch. The content which is input in the touching manner may be a text or numerical value, or a menu item which can be indicated or designated in various modes.

The touch sensor may be configured in a form of a film having a touch pattern, disposed between the window 151*a* and a display on a rear surface of the window 151*a*, or a metal wire which is patterned directly on the rear surface of the window 151*a*. Alternatively, the touch sensor may be integrally formed with the display. For example, the touch sensor may be disposed on a substrate of the display or within the display.

The display unit 151 may also form a touch screen together with the touch sensor. Here, the touch screen may serve as the user input unit 123 (see FIG. 1). Therefore, the touch screen may replace at least some of the functions of the first manipulation unit 123*a*.

The first audio output module 152*a* may be implemented in the form of a speaker to output voice audio, alarm sounds, multimedia audio reproduction, and the like.

The window 151*a* of the display unit 151 will typically include an aperture to permit audio generated by the first audio output module 152*a* to pass. One alternative is to allow audio to be released along an assembly gap between the structural bodies (for example, a gap between the window 151*a* and the front case 101). In this case, a hole independently formed to output audio sounds may not be seen or is otherwise hidden in terms of appearance, thereby further simplifying the appearance and manufacturing of the mobile terminal 100.

The optical output module 154 can be configured to output light for indicating an event generation. Examples of such events include a message reception, a call signal reception, a missed call, an alarm, a schedule notice, an email reception, information reception through an application, and the like. When a user has checked a generated event, the controller can control the optical output unit 154 to stop the light output.

The first camera 121*a* can process image frames such as still or moving images obtained by the image sensor in a capture mode or a video call mode. The processed image frames can then be displayed on the display unit 151 or stored in the memory 170.

The first and second manipulation units 123*a* and 123*b* are examples of the user input unit 123, which may be manipulated by a user to provide input to the mobile terminal 100. The first and second manipulation units 123*a* and 123*b* may also be commonly referred to as a manipulating portion, and may employ any tactile method that allows the user to perform manipulation such as touch, push, scroll, or the like. The first and second manipulation units 123*a* and 123*b* may also employ any non-tactile method that allows the user to perform manipulation such as proximity touch, hovering, or the like.

FIG. 2 illustrates the first manipulation unit 123*a* as a touch key, but possible alternatives include a mechanical key, a push key, a touch key, and combinations thereof.

Input received at the first and second manipulation units 123*a* and 123*b* may be used in various ways. For example, the first manipulation unit 123*a* may be used by the user to provide an input to a menu, home key, cancel, search, or the like, and the second manipulation unit 123*b* may be used by the user to provide an input to control a volume level being output from the first or second audio output modules 152*a* or 152*b*, to switch to a touch recognition mode of the display unit 151, or the like.

As another example of the user input unit 123, a rear input unit (not shown) may be located on the rear surface of the terminal body. The rear input unit can be manipulated by a user to provide input to the mobile terminal 100. The input may be used in a variety of different ways. For example, the rear input unit may be used by the user to provide an input for power on/off, start, end, scroll, control volume level being output from the first or second audio output modules 152*a* or 152*b*, switch to a touch recognition mode of the display unit 151, and the like. The rear input unit may be configured to permit touch input, a push input, or combinations thereof.

The rear input unit may be located to overlap the display unit 151 of the front side in a thickness direction of the terminal body. As one example, the rear input unit may be located on an upper end portion of the rear side of the terminal body such that a user can easily manipulate it using a forefinger when the user grabs the terminal body with one hand. Alternatively, the rear input unit can be positioned at most any location of the rear side of the terminal body.

Embodiments that include the rear input unit may implement some or all of the functionality of the first manipulation unit 123*a* in the rear input unit. As such, in situations where the first manipulation unit 123*a* is omitted from the front side, the display unit 151 can have a larger screen.

As a further alternative, the mobile terminal 100 may include a finger scan sensor which scans a user's fingerprint. The controller 180 can then use fingerprint information sensed by the finger scan sensor as part of an authentication procedure. The finger scan sensor may also be installed in the display unit 151 or implemented in the user input unit 123.

The microphone 122 is shown located at an end of the mobile terminal 100, but other locations are possible. If desired, multiple microphones may be implemented, with such an arrangement permitting the receiving of stereo sounds.

The interface unit 160 may serve as a path allowing the mobile terminal 100 to interface with external devices. For example, the interface unit 160 may include one or more of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the mobile terminal 100. The interface unit 160 may be implemented in the form of a socket for accommodating an external card, such as Subscriber Identification Module (SIM), User Identity Module (UIM), or a memory card for information storage.

The second camera 121*b* is shown located at the rear side of the terminal body and includes an image capturing direction that is substantially opposite to the image capturing direction of the first camera unit 121*a*. If desired, second camera 121*a* may alternatively be located at other locations, or made to be moveable, in order to have a different image capturing direction from that which is shown.

The second camera 121*b* can include a plurality of lenses arranged along at least one line. The plurality of lenses may also be arranged in a matrix configuration. The cameras may be referred to as an "array camera." When the second camera 121*b* is implemented as an array camera, images may be captured in various manners using the plurality of lenses and images with better qualities.

As shown in FIG. 3, a flash 124 is shown adjacent to the second camera 121*b*. When an image of a subject is captured with the camera 121*b*, the flash 124 may illuminate the subject.

As shown in FIG. 1B, the second audio output module 152*b* can be located on the terminal body. The second audio output module 152*b* may implement stereophonic sound functions in conjunction with the first audio output module 152*a*, and may be also used for implementing a speaker phone mode for call communication.

At least one antenna for wireless communication may be located on the terminal body. The antenna may be installed in the terminal body or formed by the case. For example, an antenna which configures a part of the broadcast receiving module 111 may be retractable into the terminal body. Alternatively, an antenna may be formed using a film attached to an inner surface of the rear cover 103, or a case that includes a conductive material.

A power supply unit 190 for supplying power to the mobile terminal 100 may include a battery 191, which is mounted in the terminal body or detachably coupled to an outside of the terminal body. The battery 191 may receive power via a power source cable connected to the interface unit 160. Also, the battery 191 can be recharged in a wireless manner using a wireless charger. Wireless charging may be implemented by magnetic induction or electromagnetic resonance.

The rear cover 103 is shown coupled to the rear case 102 for shielding the battery 191, to prevent separation of the battery 191, and to protect the battery 191 from an external impact or from foreign material. When the battery 191 is detachable from the terminal body, the rear case 103 may be detachably coupled to the rear case 102.

An accessory for protecting an appearance or assisting or extending the functions of the mobile terminal 100 can also be provided on the mobile terminal 100. As one example of an accessory, a cover or pouch for covering or accommodating at least one surface of the mobile terminal 100 may be provided. The cover or pouch may cooperate with the display unit 151 to extend the function of the mobile terminal 100. Another example of the accessory is a touch pen for assisting or extending a touch input to a touch screen.

According to one embodiment of the present invention, a plug of an earphone with a cable-type battery is inserted into the earphone port 161 of the mobile terminal 100, and power is supplied to the mobile terminal 100 through the cable-type battery. The structure and the function of the earphone plug needs to be modified so that the earphone can be used as an auxiliary battery for the mobile terminal 100 as an audio output path of the mobile terminal 100, which will be described with reference to FIGS. 4 to 5.

Figure 4:
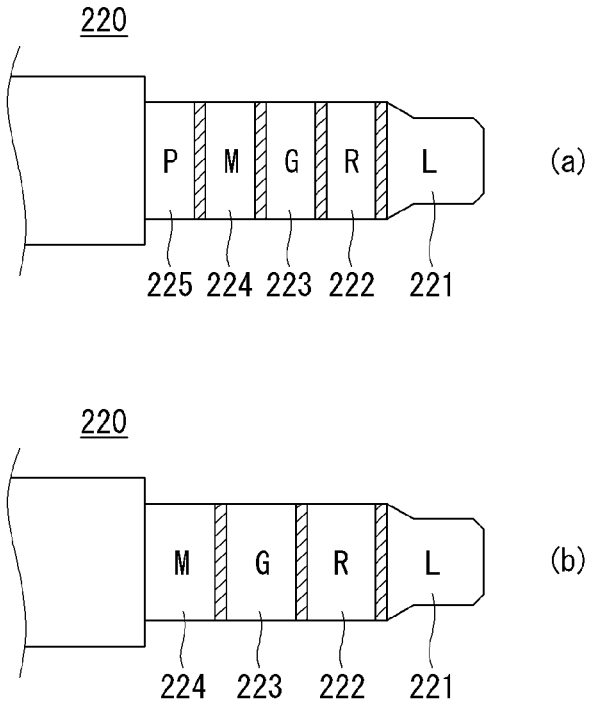
FIG. 4 illustrates an example of a plug of an earphone with a cable-type battery according to one embodiment of the present invention.

FIG. 4 illustrates an example of a plug of an earphone with a cable-type battery according to one embodiment of the present invention.

The plug 220 of an earphone with a cable-type battery can comprise a left audio out (L), right audio out (R), ground (G), microphone (H), and power (P) terminal. The standard 4-pole earphone plug comprises L, R, G, and M terminal. If an earphone according to one embodiment of the present invention needs to supply power to the mobile terminal 100 in addition to the conventional audio output function, the power terminal P has to be implemented additionally (see FIG. 4(*a*)). Meanwhile, a control signal meant for controlling a charging and discharging function related to the cable-type battery can be transmitted and received through the microphone (M) terminal or the power (P) terminal.

As shown in FIG. 4(*a*), the power terminal (P) can be implemented by adding the power terminal to the standard 4-pole plug. However, any one terminal of the standard 4-pole plug can be modified to support two functions at the same terminal.

For example, with reference to FIG. 4(*b*), the standard 4-pole plug can be re-designed to divide the microphone pole so that the microphone pole (M) and the power pole (P) can be implemented in the same terminal. The earphone 200 with a cable-type battery according to one embodiment of the present invention includes a microphone 240, where the microphone module can include a control means (for example, a play button, stop button, and so on) to control the audio output from the mobile terminal 100 in addition to the microphone 240. In case the earphone 200 carries out the function of a microphone or is not used for controlling the audio output function of the mobile terminal 100, the earphone 200 can supply power to the mobile terminal 100 through the power pole (P).

Meanwhile, although the examples above assume that a cable-type battery supplies power to the mobile terminal 100 or charges the mobile terminal 100, power of the mobile terminal 100 can be transmitted to the earphone 200 with a cable-type battery through the power terminal (P) shown in FIG. 4.

In other words, the earphone with a cable-type battery applied to the implementation of one embodiment of the present invention can be inserted into the mobile terminal 100 so that both of the charging and discharging function can be carried out.

Now an example of supplying power to the mobile terminal 100 through an earphone with a cable-type battery according to one embodiment of the present invention will be described in more detail with reference to FIG. 5. For the convenience of description, it is assumed that the plug of an earphone with the cable-type battery has the structure of FIG. 4(*a*).

Meanwhile, the structure of a plug terminal of an earphone with a cable-type battery can have various other forms in addition to the structure of FIG. 4. However, it should be noted that the plug terminal of an earphone with a cable-type battery has to include a power supply path and a control signal transmission and reception path for carrying out a charging and discharging function related to the cable-type battery.

Figure 5:
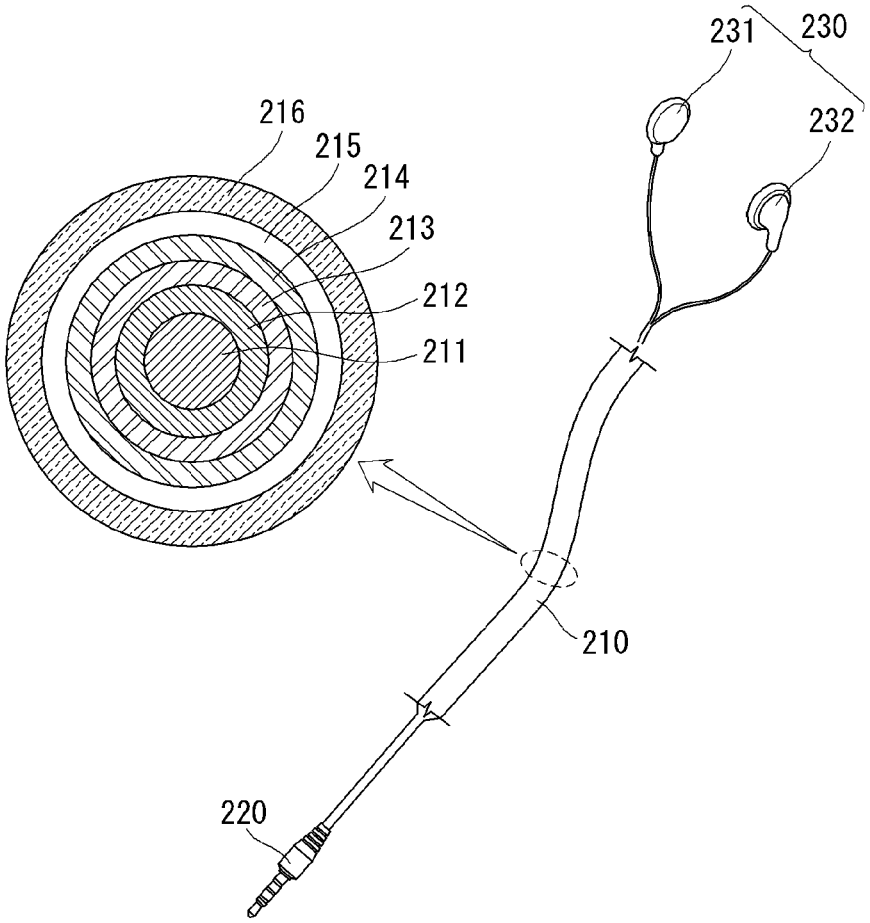
FIG. 5 illustrates one cross section of a cable of an earphone with a cable-type battery to which one embodiment of the present invention is applied.

FIG. 5 illustrates one cross section of a cable of an earphone with a cable-type battery to which one embodiment of the present invention is applied.

The earphone 200 applied to implement one embodiment of the present invention can have a cable-type battery within the earphone cable 210. The cable-type battery is detailed in the patent application 10-2012-0019977, and the cross section of the cable-type battery will be described briefly with reference to FIG. 6.

The cable-type secondary battery 210 comprises an anode current collector 211 which has a cross section of a predetermined shape and extends in a longitudinal direction; an anode active material pattern layer 212 which is formed by anode active material patterns spaced apart from one another by a predetermined interval on the outer surface of the anode current collector; an electrolyte layer 30 which surrounds the anode active material pattern layer and provides an ion-filled channel; a cathode active material pattern layer 214 which is formed by the cathode active material patterns spaced apart from one another by a predetermined interval at the locations corresponding to the anode active material patterns on the outer surface of the electrolyte layer; and a cathode current collector 215 which surrounds the outer surface of the cathode active material pattern layer. The term of predetermined shape indicates that no particular shape is preferred; therefore, an arbitrary shape can be used as long as the shape does not impair the technical principles of the present invention. The cable-type battery of the present invention has a horizontal cross section of a predetermined shape, a linear structure which extends in a longitudinal direction with respect to the horizontal cross section, and flexibility, thereby being capable of changing its shape freely.

Meanwhile, the cable-type battery 210 can have protective sheath. The protective sheath 216, made of insulator, is formed on the outer surface of the cathode current collector 215 to protect electrodes against moisture in the air and an external shock. The protective sheath 216 is made usually from polymer resin, including PVC, HDPE, and epoxy resin.

The cross sectional structure of the cable-type battery 210 has been described; however, the present invention is not limited to the description above. For example, additional flexibility can be obtained from the cable-type battery structure; however, various problems due to the additional flexibility can be dealt with by applying an appropriate change to structural design of the cable-type battery.

In what follows, described with reference to various drawings will be examples of carrying out a charging and discharging function related to the cable-type battery and the main battery 191 and examples of controlling an operation of a mobile terminal including the charging and discharging function related to the cable-type battery and the main battery 191 based on a user's operation on the earphone cable in case an earphone with the cable-type battery is connected to the mobile terminal 100.

FIGS. 6 to 10 illustrate examples of a graphic user interface provided by the mobile terminal 100 in case an earphone 200 with a cable-type battery 210 is connected to the mobile terminal 100 according to the present invention.

Figure 6:
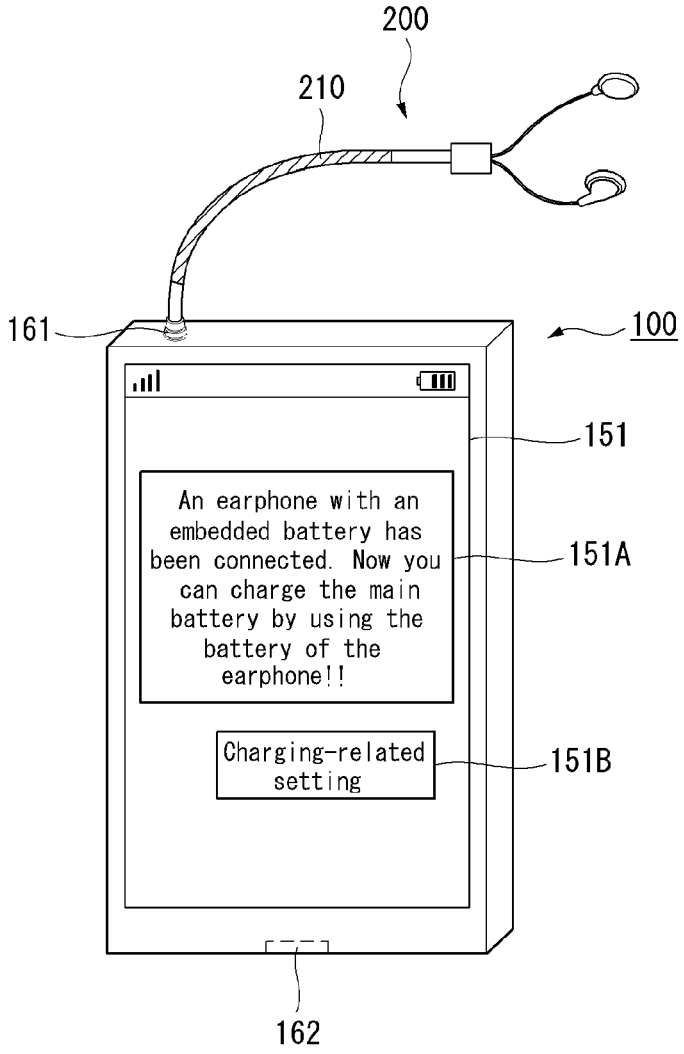
FIGS. 6 to 10 illustrate examples of a graphic user interface provided by the mobile terminal in case an earphone with a cable-type battery is connected to a mobile terminal according to the present invention.

With reference to FIG. 6, if the earphone 200 is connected through the earphone port 161 of the mobile terminal 100, the controller 180 can control the display unit 151 to display a message 151A informing that the main battery 191 can be charged through the cable-type battery 210. And the controller 180 can also provide a user interface 151B for setting up parameters related to charging through the cable-type battery 210. The user can set up parameters related to charging through the cable-type battery 210 by touching the user interface 151B.

Figure 7:
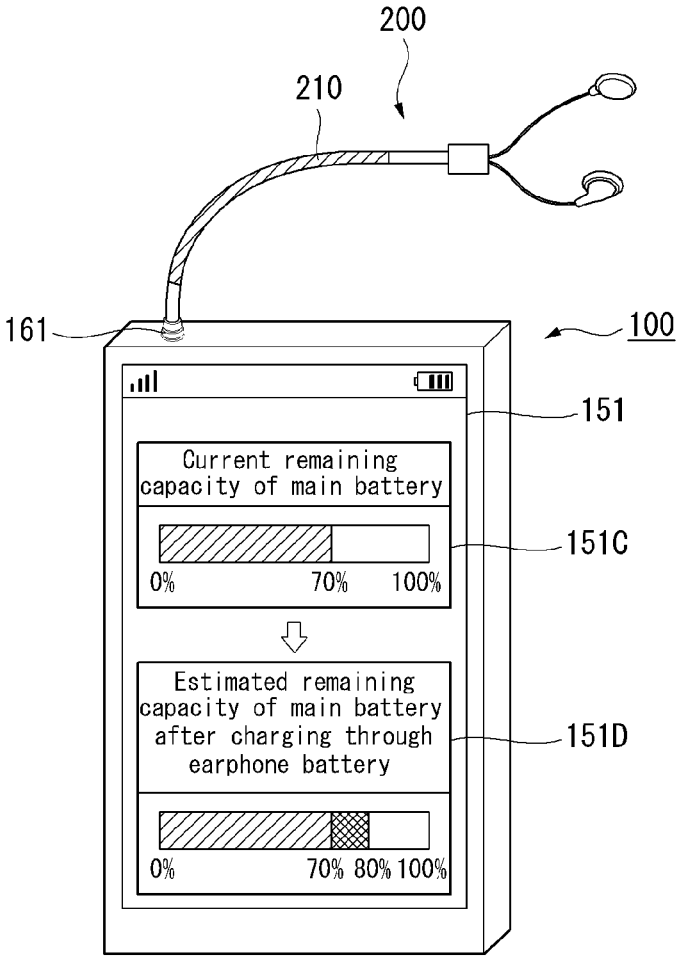

With respect to FIG. 7, if the earphone is connected 200, the controller 180 controls the display unit 151 to display a user interface 151C informing of a current remaining capacity of the main battery 191 and a user interface 151D informing of the fact that the remaining capacity of the main battery 191 can be increased if the main battery 191 is charged through the cable-type battery.

Figure 8:
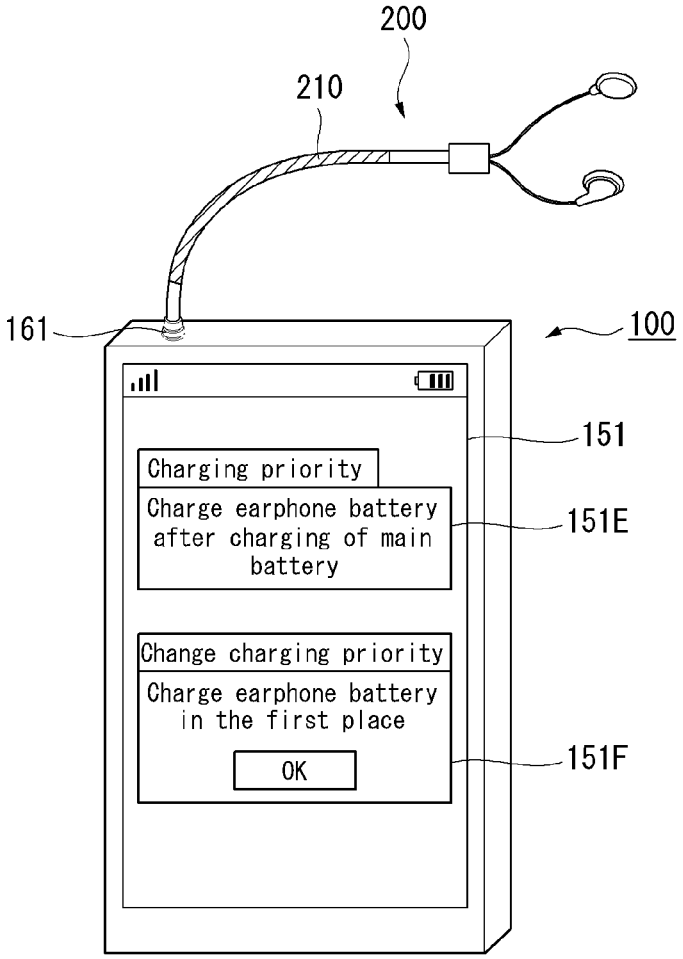

With reference to FIG. 8, if the earphone 200 is connected, the controller 180 can control the display unit 151 to display a user interface 151E informing of current charging priorities and a user interface 151F for setting up or changing charging priorities. In case the cable-type battery 210 has a higher priority than the others, the controller 180 can provide a function for setting through the user interface 151F so that the main battery is charged first of all.

Figure 9:
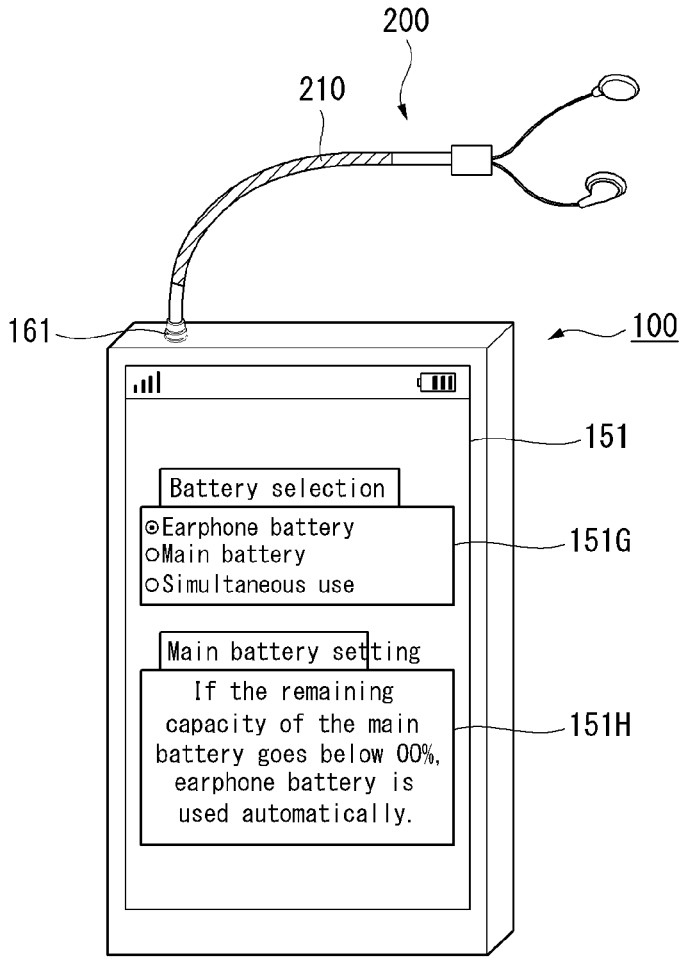

With reference to FIG. 9, if the earphone is connected 200, the controller 180 can provide a user interface 151G for setting whether to use the cable-type battery 210 as an independent power source. The user, by touching a circular selection area included in the user interface 151G, can choose between the main battery 191 and the cable-type battery 210 or choose to use both of the batteries.

Also, the controller 180 can provide through the display unit 151 a user interface 151H for setting remaining capacity of the main battery 191 to use the cable-type battery 210 automatically as an independent power source. The user can set up the remaining capacity of the main battery 191 by entering a number by touching the box area of the user interface 151H. Depending on situations, the controller 180 can provide a default value for the remaining capacity of the main battery through the user interface 151H.

Figure 10:
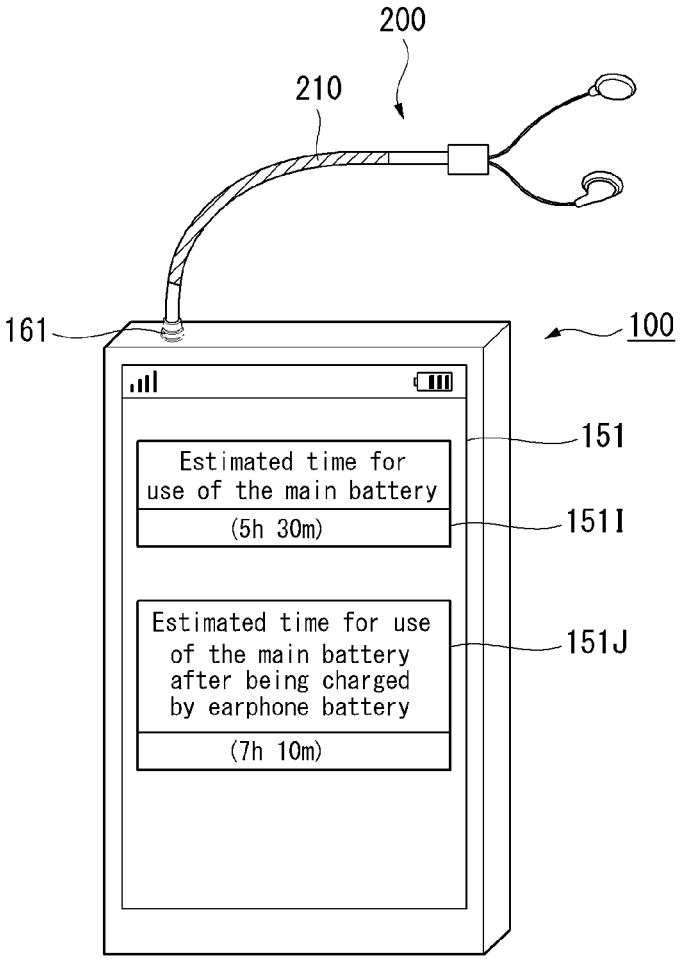

With reference to FIG. 10, if the earphone 200 is connected, the controller 180 can provide current estimated time for use 151I of the main battery 191 and estimated time for use 151J of the main battery 191 after being charged by the cable-type battery 210.

Meanwhile, the examples of the user interface provided according to connection of the earphone 200 with the cable-type battery 210 are not limited to the examples above. And the controller 180 can carry out a function of providing a user interface regardless of whether external power is supplied through the external charging port 162 or whether a wireless charging signal is received or not.

Figure 11:
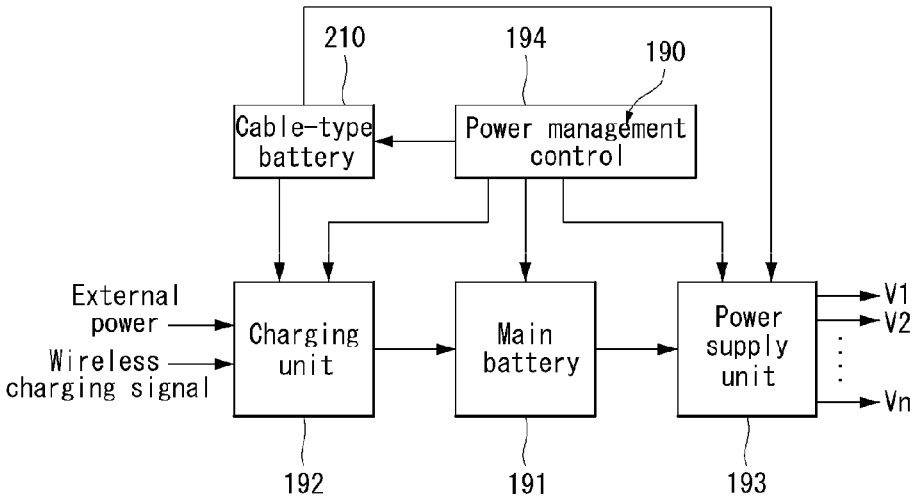
FIG. 11 is a block diagram of one example of a power supply unit of a mobile terminal according to the present invention.

FIG. 11 is a block diagram of one example of a power supply unit 190 of a mobile terminal 100 according to the present invention. The power supply unit 190 can control a charging and discharging operation with respect to the main battery 191 and the cable-type battery 210 under the control of the controller 180 of the mobile terminal 100. With reference to FIG. 11, the power supply unit 190 can comprise the main battery 191, a charging unit 192, a power supply unit 193, and a power management controller 194.

The main battery 191 carries out the role of a power source for each constituting element of the mobile terminal 100. The charging unit 192 can charge the main battery 191 base on the external power supplied through the external charging port 162. And the charging unit 192 can also charge the main battery 191 by using the power of the cable-type battery embedded in the earphone 200 connected to the earphone port 161. And the charging unit 192 can also charge the main battery 191 based on a wireless charging signal received from a wireless charging device (not shown). The wireless charging method carried out by the charging unit 192 may use magnetic induction or magnetic resonance. However, the technical scope of the present invention is not limited to a particular charging method.

The power supply unit 193 can generate various voltages V1, V2, . . . , Vn required to operate constituting elements of the mobile terminal 100 based on the power of the main battery 191 and provide the generated voltage to the constituting elements. And depending on situations, the power supply unit 193 can generate the voltages V1, V2, . . . , Vn based on the power of the cable-type battery 210 and provide the generated voltage to the constituting elements. Also, the power supply uni t193 can generate the voltages V1, V2, . . . , Vn by using both of the main battery 191 and the cable-type battery 210 and provide the voltage to the constituting elements.

The power management controller 194 can control the overall operation of the constituting elements of the power supply unit 190. The power management controller 194 can be controlled by the controller 180. Depending on situations, the power management controller 194 can form part of the controller 180.

Though not shown in the figure, the power supply unit 190 can store software or data required for the operation of the power supply unit 190 and incorporate therein a data storage component capable of storing information or data generated during the operation of the power supply unit 190.

Figure 12:
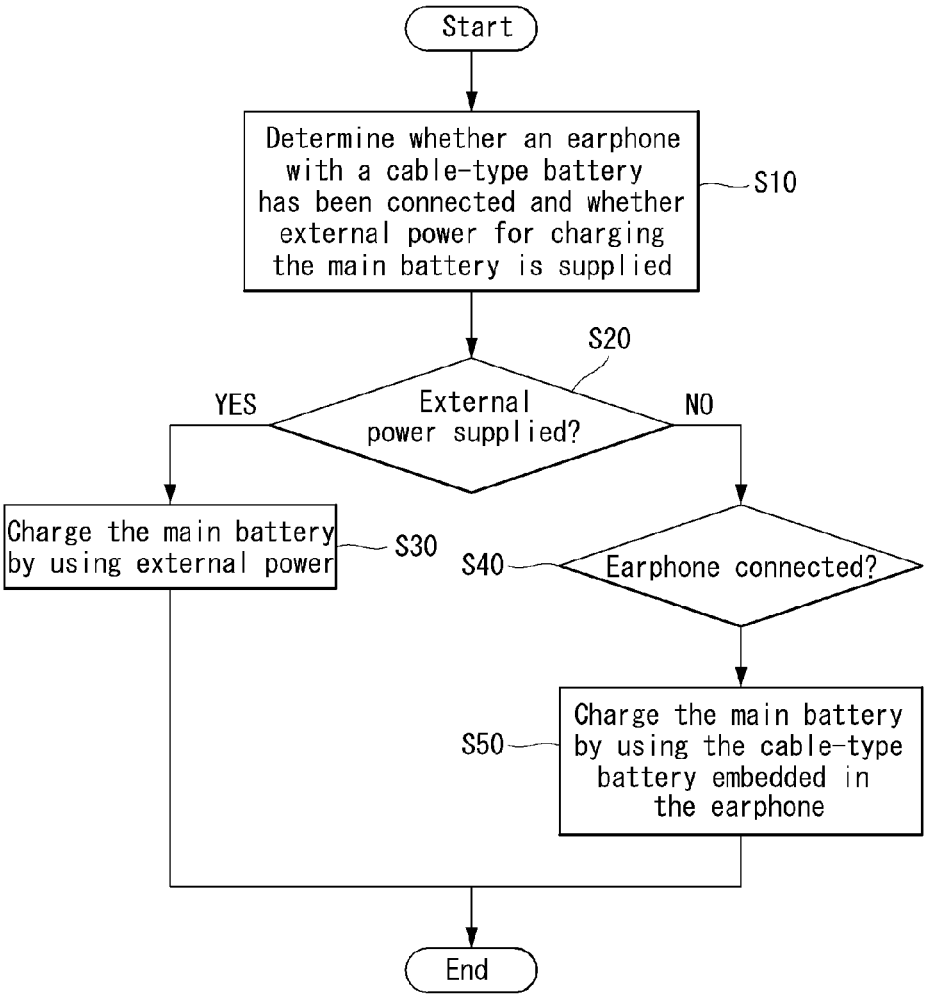
FIG. 12 is a flow diagram illustrating one example of a method for operating a mobile terminal according to the present invention.

FIG. 12 is a flow diagram illustrating one example of a method for operating a mobile terminal according to the present invention. In what follows, the method for operating a mobile terminal will be described with reference to related drawings.

The controller 180 of the mobile terminal 100 determines whether an earphone 200 with a cable-type battery 210 is connected through an earphone port 161 and whether external power is supplied to charge the main battery 191, S10. At this time, external power may originate from external power supplied through a charging cable connected to the charging port 162 or from a wireless power charging signal received by a predetermined wireless charging method.

If it is determined that the external power is being supplied S20, YES, the controller 180 controls the power supply unit 190 so that the main battery 191 can be charged by the external power S30. The charging method by using the external power may use a wired charging method based on the external power supplied through the charging port or a wireless charging method based on a wireless charging signal.

However, if it is determined that the external power is not currently supplied S20, NO, the controller 180 determines whether the earphone 200 with the cable-type battery 210 is connected S40. If it is determined that the earphone 200 with the cable-type battery 210 is connected YES, the controller 180 controls the power supply unit 190 so that the main battery 191 can be charged by the cable-type battery 210 embedded in the earphone 200, S50.

Figure 13:
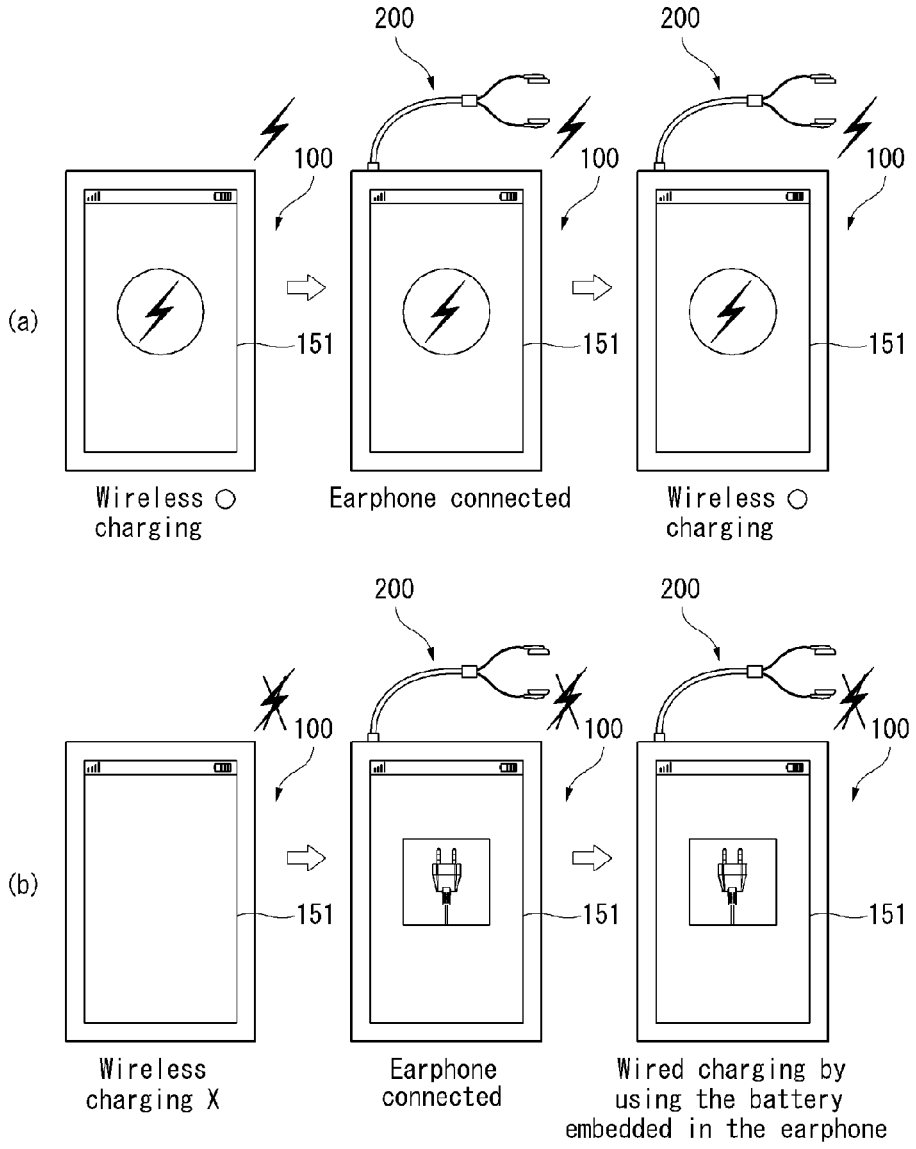
FIGS. 13 and 14 illustrate examples of charging a main battery according to the method for operating a mobile terminal of FIG. 12.
Figure 14:
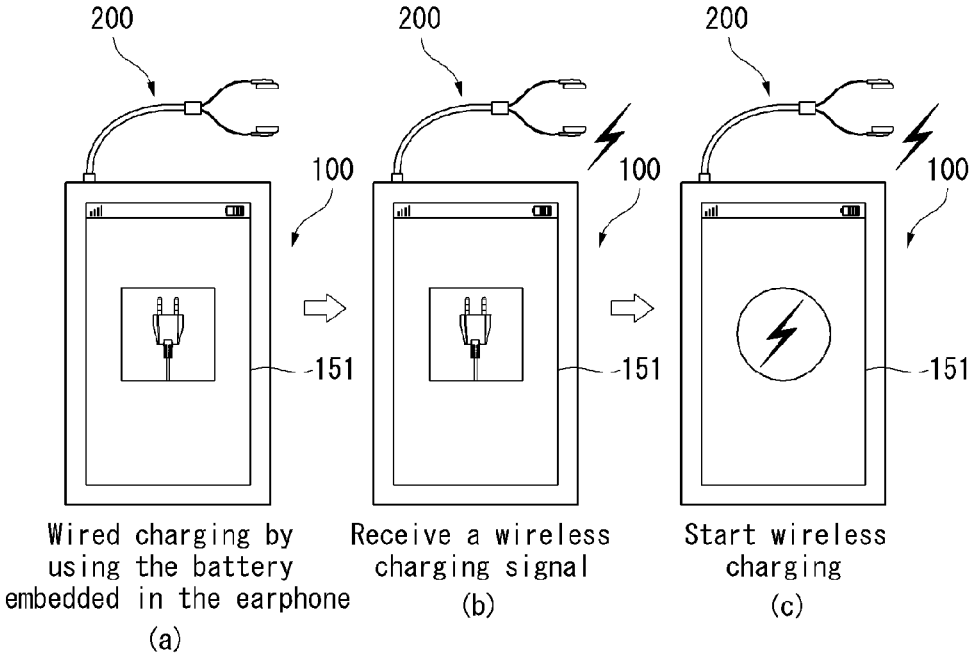

FIGS. 13 and 14 illustrate examples of charging a main battery 191 according to the method for operating a mobile terminal of FIG. 12.

With reference to FIG. 13(*a*), in case an earphone 200 with a cable-type battery 210 is connected while wireless charging is carried out with respect to the main battery 191 by using a wireless charging signal, the controller 180 can continue wireless charging by using a wireless charging signal. The lightning-shaped icon displayed on the display unit 151 of the mobile terminal 100 indicates that wireless charging with respect to the main battery 191 is under way.

Similar to the example of FIG. 13(*a*), the controller 180 can continue charging the main battery 191 by using the external power in case an earphone 200 with the cable-type battery 210 is connected while the main battery 191 is being charged by external power through the charging cable 162.

With reference to FIG. 13(*b*), suppose the earphone 200 with the cable-type battery 210 is connected while wireless charging of the main battery 191 is not carried out. The controller 180 can then charge the main battery 191 by using the cable-type battery 210. The code-shaped icon displayed on the display unit 151 of the mobile terminal 100 indicates that wired charging is being carried out with respect to the main battery 191.

Meanwhile, the example of FIG. 13(*b*) assumes that external power is not provided through the charging port 162. In case external power is supplied through the charging port 162, the controller 180 can charge the main battery 191 based on the external power rather than the cable-type battery 210.

As described above, if the earphone 200 is connected, the controller 200 determines whether external power for wired or wireless charging of the main battery 191 is supplied. Next, the controller 180 charges the main battery 191 by using the external power if the earphone 200 is connected while the external power is being supplied. On the other hand, if the earphone 200 is connected while the external power is not supplied, the power supply unit 190 can be controlled so that the main power 191 can be charged by the cable-type battery 210 embedded in the earphone 200.

FIG. 14(*a*) illustrates a situation where the main battery 191 is charged by the cable-type battery 210 embedded in the earphone 200. FIG. 14(*b*) illustrates a situation where a wireless charging signal is received under the condition of FIG. 14(*a*). Then as shown in FIG. 11(*c*), the controller 180 starts charging of the main battery 191 by using the wireless charging signal. Similar to the example of FIG. 13, in case external power is supplied through the charging port 162 while the main battery 191 is charged by the cable-type battery 210 embedded in the earphone 200, the main battery 191 can be charged by the external power.

Inclusive of the examples of FIG. 14, if external power meant for wired or wireless charging of the main battery 191 is supplied, the controller 180 can control the power supply unit 190 so that the main battery can be charged by the external power regardless of whether an earphone 200 with a cable-type battery 210 is connected or not.

Figure 15:
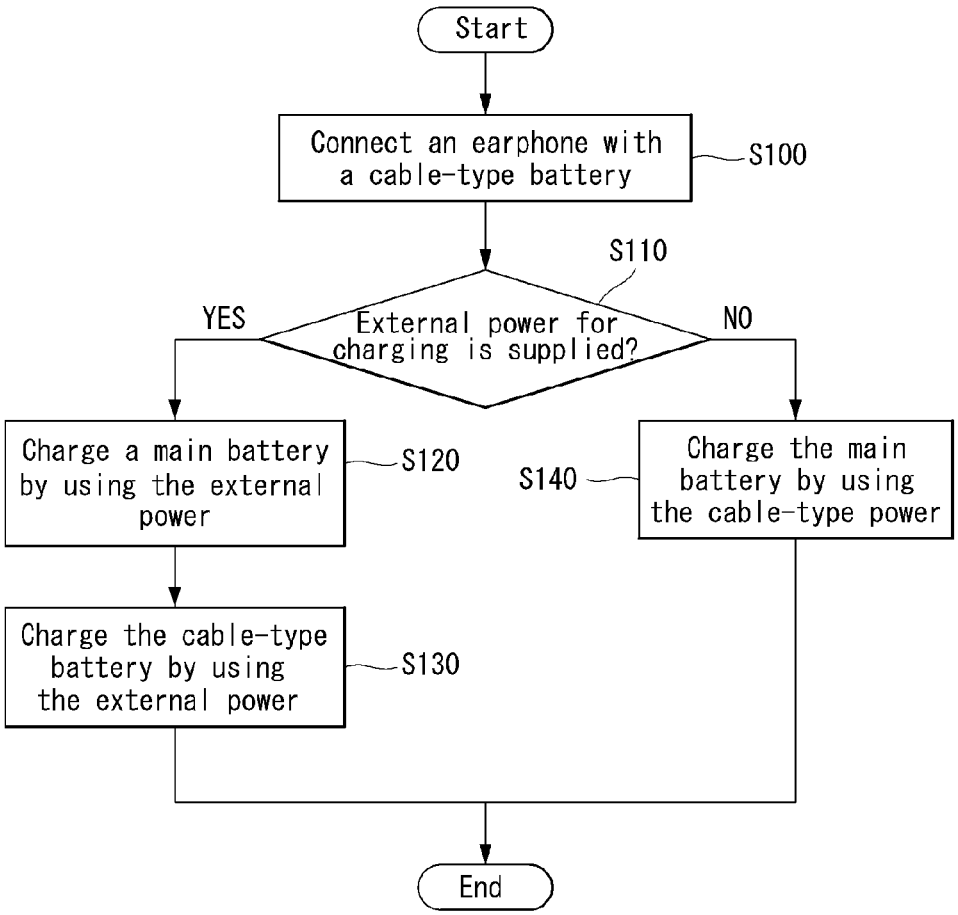
FIG. 15 is a flow diagram illustrating one example of a method for operating a mobile terminal according to the present invention.

FIG. 15 is a flow diagram illustrating one example of a method for operating a mobile terminal according to the present invention. In what follows, the method for operating a mobile terminal will be described with reference to related drawings.

An earphone 200 with a cable-type battery is connected to an earphone port 161, S100. Then the controller 180 determines whether external power supplied through an external charging port 162, S110.

If it is determined that the external power is being supplied (YES), the controller 180 controls the power supply unit 190 so that the main battery 191 can be charged by external power S120. Then the controller 180 controls the power supply unit 190 so that the cable-type battery 210 embedded in the earphone 200 can be charged by the external power S130.

Meanwhile, power supply to the cable battery 210 from the external power can be carried out through a power terminal (P) in the case of an earphone plug of FIG. 4(*a*) or through a microphone terminal (M) in the case of an earphone plug of FIG. 4(*b*). This scheme can be applied in the same manner for a case where power is supplied in a direction from the cable-type battery 210 to the mobile terminal 100. At this time, power supply to the mobile terminal 100 may be intended for charging the main battery 191 or may be used as operating power of the mobile terminal 100.

According to one embodiment of the present invention, the controller 180 may start charging of the cable-type battery in case charging of the main battery by the external power is completed. According to another embodiment of the present invention, charging of the cable-type battery can be started if a charging level of the main battery reaches a predetermined level while the external power is charging the main battery.

If it is determined from the S110 step that the external power is not supplied (NO), the controller 180 controls the power supply unit 190 so that the main battery 191 can be charged by the cable-type battery 210, S140. However, if the remaining capacity of the main battery 191 exceeds a predetermined capacity, the controller 180 may not carry out a charging operation with respect to the main battery 191 by using the cable battery 210. However, if the remaining capacity of the main battery 191 goes bellows a predetermined capacity according to the use of the mobile terminal 100, the main battery can be charged by using the cable-type battery 210.

Meanwhile, the method for operating a mobile terminal of FIG. 15 has assumed that a charging means for the main battery 191 is determined according to whether external power meant for charging the main battery 191 is supplied through a charging port 162. In case an earphone 200 with a cable-type battery 210 is connected, the method for operating a mobile terminal such as the above can also be applied for a situation where a charging means for the main battery 191 is determined according to whether a wireless charging method is employed.

In other words, in case the earphone 200 is connected and wireless charging is under progress, external power based on a wireless charging signal continues to be used for charging the main battery 191. On the other hand, if wireless charging is not currently employed, the cable-type battery 210 can be used for charging of the main battery 191. Since application examples based on the description above can be easily understood from the embodiment of FIG. 12 by those skilled in the art or are well-known to those skilled in the art, detailed descriptions thereof will be omitted.

Figure 16:
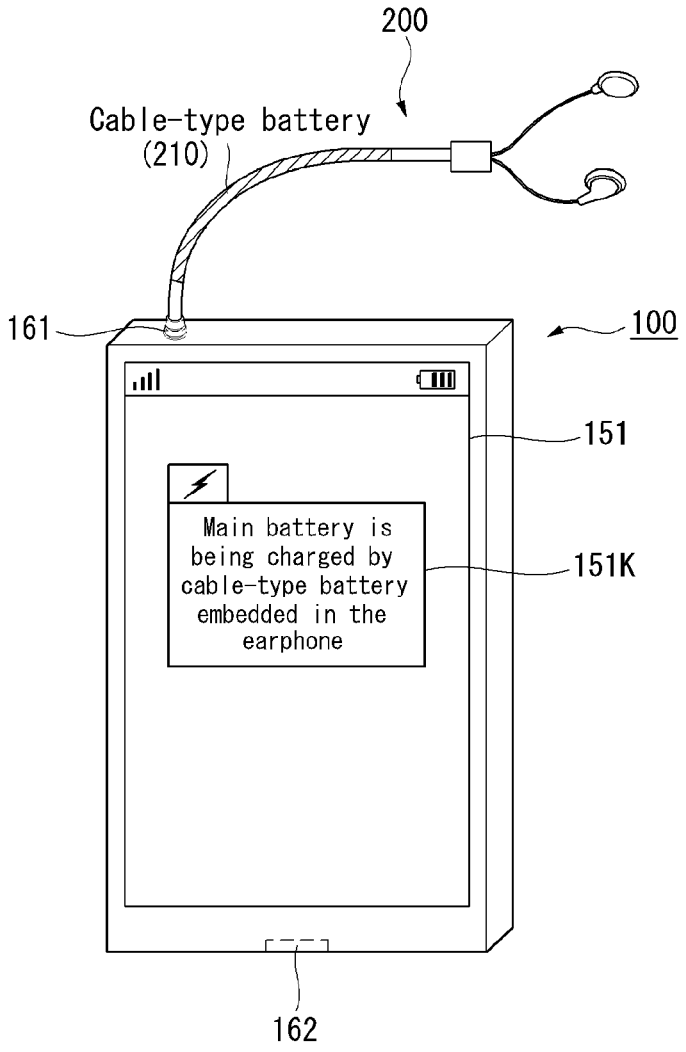
FIGS. 16 to 18 illustrate examples of a graphic user interface provided by a mobile terminal according to the present invention in case an earphone with a cable-type battery is connected while charging of a main battery through external power is not carried out.
Figure 17:
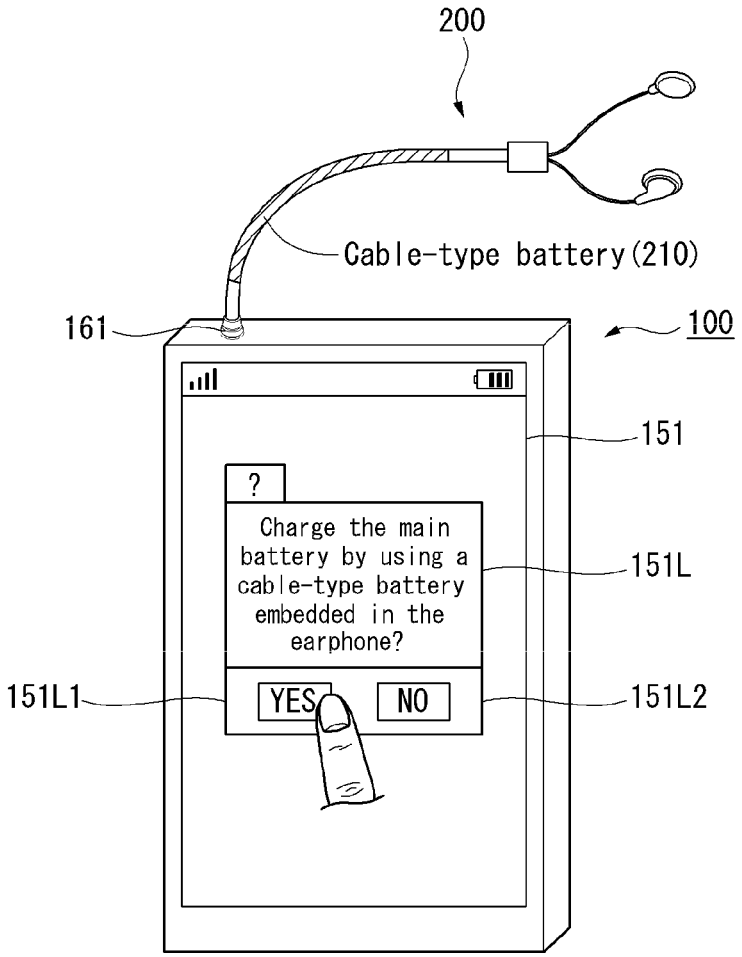
Figure 18:
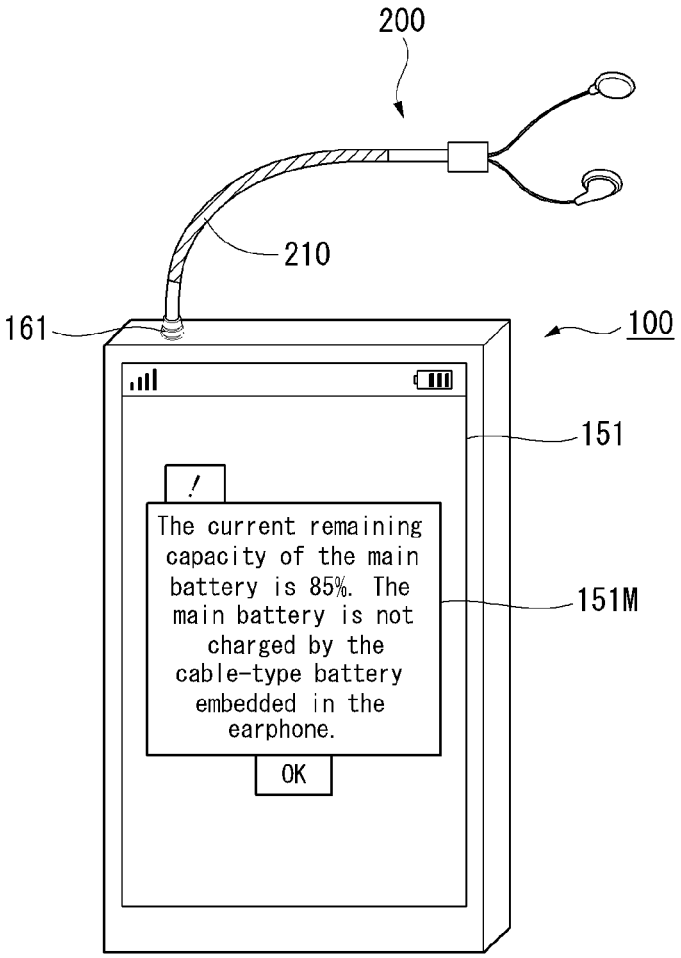

FIGS. 16 to 18 illustrate examples of a graphic user interface provided by a mobile terminal 100 according to the present invention in case an earphone with a cable-type battery connected while charging of a main battery 191 through external power is not carried out.

If an earphone 200 with a cable-type battery 210 is connected through an earphone port 161 while external power is not supplied through the external charging port 162, as shown in FIG. 16, the controller 180 can display on the display unit 151 a message 151K informing of charging of the main battery 191 by using the cable-type battery 210 embedded in the earphone 200.

In other words, once the earphone 200 with the cable-type battery 210 is connected to the earphone port 161 regardless of an operation state of the mobile terminal 100, a mobile terminal 100 according to the present invention charges the main battery 191 by using the cable-type battery 210 embedded in the earphone 200.

If the earphone 200 is connected through the earphone port 161 while external power is not provided through the external charging port 162, as shown in FIG. 17, the controller 180 can display on the display unit 151 a message 151L meant for determining whether to charge the main battery 191 by using the cable-type battery 210 embedded in the earphone 200.

Then the user, by touching the 'YES' button 151L1, may charge the main battery 191 by using the cable-type battery 210; similarly, the user, by touching the 'NO' button 151L2, may not charge the main battery 191 by using the cable-type battery 210.

If the earphone 200 is connected through the earphone port 161 while external power is not provided through the external charging port 162, as shown in FIG. 18, the controller 180 can display on the display unit 151 a message 15151 indicating that the main battery 191 is not charged by the cable-type battery 210 since the current remaining capacity of the main battery is enough.

In other words, the mobile terminal 100 according to the present invention is allowed to carry out charging of the main battery 191 by using the cable-type battery 210 embedded in the earphone 200 only when the remaining capacity of the main battery 191 is below a predetermined threshold.

Figure 19:
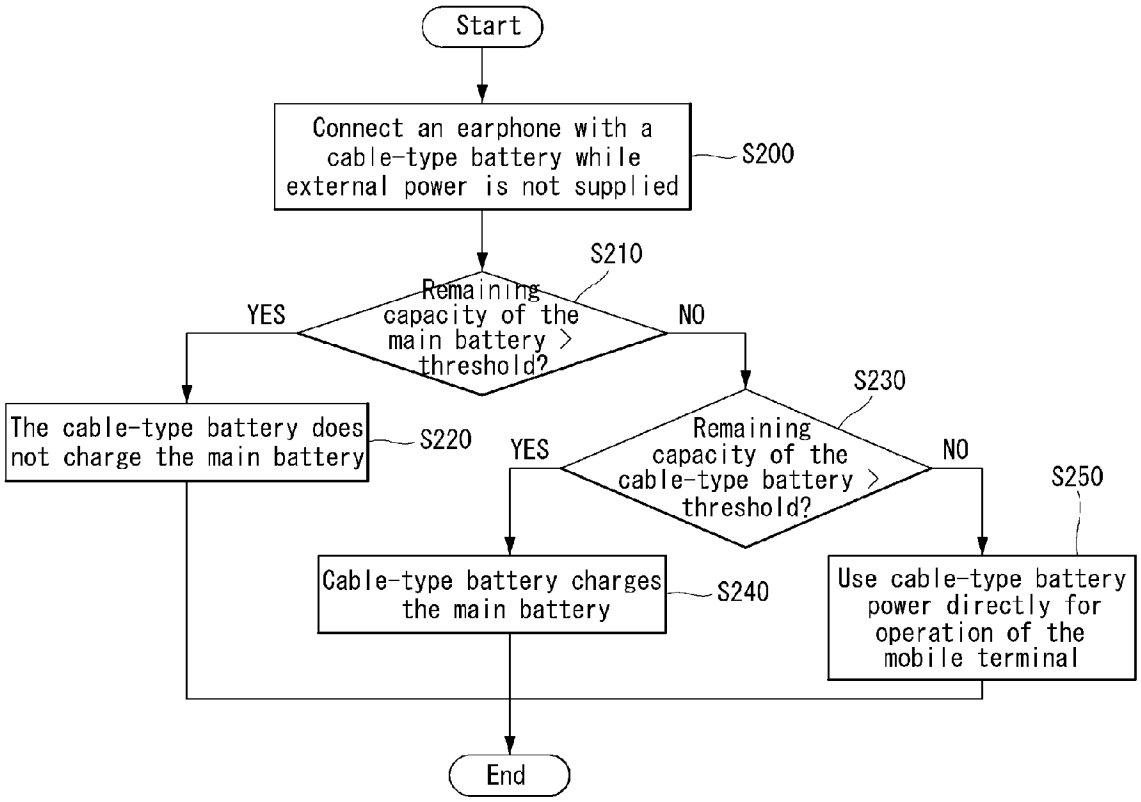
FIG. 19 is a flow diagram illustrating another example of a method for operating a mobile terminal according to the present invention.

FIG. 19 is a flow diagram illustrating another example of a method for operating a mobile terminal according to the present invention. In what follows, the method for operating a mobile terminal will be described with reference to related drawings.

An earphone 200 with a cable-type battery 210 is connected while external power is not supplied through an external charging port 162, S200. Then the controller 180 determines whether the remaining capacity of the main battery 191 exceeds a threshold S210.

In case the remaining capacity of the main battery 191 is larger than a threshold (YES), the controller 180 does not charge the main battery 191 by using the cable-type battery 210, S220. At this time, the earphone 200 merely performs the original earphone function.

However, in case the remaining capacity of the main battery 191 is less than the threshold (NO), the controller 180 determines whether the remaining capacity of the cable-type battery 210 is larger than the threshold S230. It is preferable to have the threshold at the step of S210 is larger than that used in the step of S230. This is so because the capacity of the main battery 191 is larger than that of the cable-type battery 210 for most cases.

If it is determined from the S230 step that the remaining capacity of the cable-type battery 210 is larger than the threshold, the controller 180 charges the main battery 191 by using the cable-type battery 210, S240.

However, if it is determined from the S230 that the remaining capacity of the cable-type battery 210 is less than the threshold, the controller 130 uses the power of the cable-type battery 210 directly for operating the mobile terminal 100, S250. In other words, the controller 180, instead of charging the main battery 191 by using the power of the cable-type battery 210, can use the power of the cable-type battery 210 directly to operate the mobile terminal 100. This intended to increase a rate of power usage by preventing power loss that may occur during a charging process since both of the remaining capacities of the main battery 191 and the cable-type battery 210 are not enough.

In this case, the power supply unit 190 can generate a voltage required for operation of constituting elements of the mobile terminal 100 by using the cable-type battery 210 as a power source. Meanwhile, the controller 180 can also use the main battery 191 as a power source of the mobile terminal 100 even if the cable-type battery 210 is used as a direct power source of the mobile terminal 100.

With reference to the power supply unit 190 of FIG. 14, the power supply unit 193 can receive power from the main battery 191 and the cable-type battery 210 in parallel and generate voltages V1, V2, . . . , Vn required for operation of constituting elements of the mobile terminal 100.

Meanwhile, the example of FIG. 19 can be applied similarly to a situation where the main battery 191 is not charged by a wireless charging method. However, since such an extension of the application can be easily understood from the embodiment of FIG. 16 by those skilled in the art or is well-known to those skilled in the art, detailed descriptions thereof will be omitted.

Figure 20:
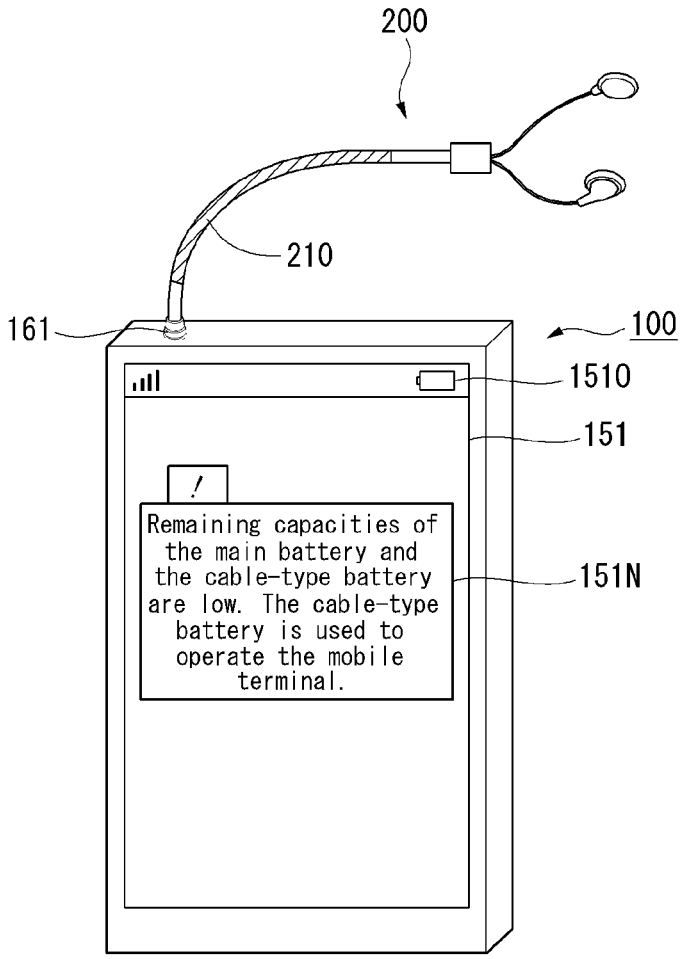
FIG. 20 illustrates an example where a cable-type battery embedded in an earphone is used as a power source of a mobile terminal according to a method for operating the mobile terminal of FIG. 19.

FIG. 20 illustrates an example where a cable-type battery 210 embedded in an earphone 200 is used as a power source of a mobile terminal 100 according to a method for operating the mobile terminal of FIG. 19.

With reference to a message 151N of FIG. 20, it can be known that the mobile terminal 100 can use the power of the cable-type battery 210 directly for the operation of the mobile terminal 100 in case remaining capacities of both of the main battery 191 and the cable-type battery 210 are not enough. From the icon 151O in the indicator area of FIG. 19 shows that the remaining capacity of the main battery 191 is very low.

Up to this point, with reference to FIGS. 19 and 20, a condition for the cable-type battery 210 embedded in the earphone 200 to be used directly as a power source of the mobile terminal 100 is that remaining capacities of both of the cable-type battery 210 and the main battery 191 are insufficient.

However, the above example is not the only condition applied for the cable-type battery 210 to be used as an independent power source of the mobile terminal 100. For example, the mobile terminal 100, taking account of only one of the main battery 191 and the cable-type battery 210, can use the cable-type battery 210 as a power source of the mobile terminal 100.

Also, instead of considering both of the capacities of the memory 170 and the cable-type battery 210, the mobile terminal 100 can use the cable-type battery 210 as a direct power source of the mobile terminal 100 by taking account of a function or an application under execution in the mobile terminal 100, a condition predetermined by the user, or the surroundings of the mobile terminal 100.

Figure 21:
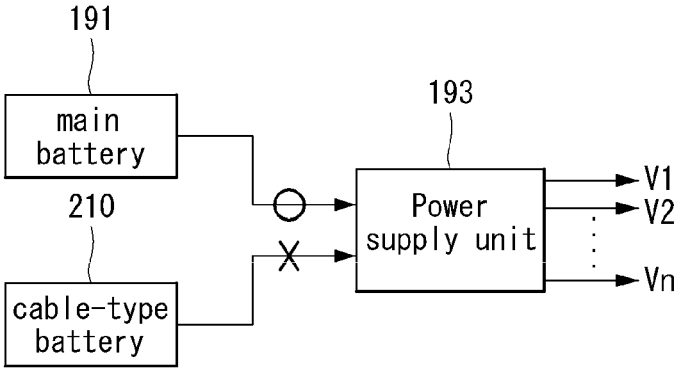
FIG. 21 illustrate types of power source usage of a mobile terminal 100 according to the present invention.
Figure 21:
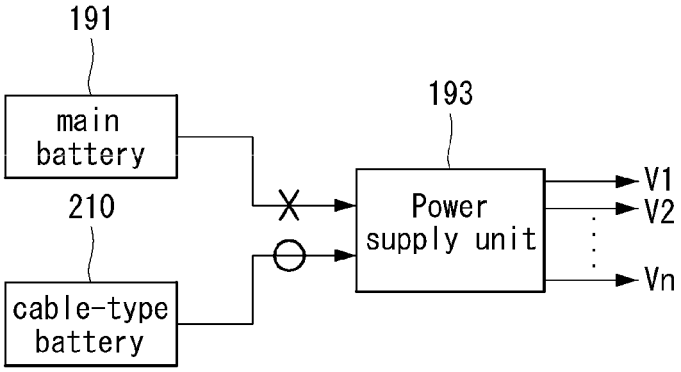
Figure 21:
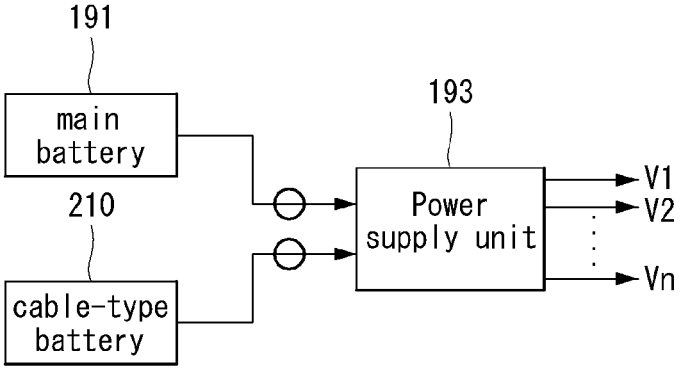

FIG. 21 illustrates types of power source usage of a mobile terminal 100 according to the present invention.

With reference to FIG. 21(*a*), the mobile terminal 100 generates voltages V1, V2, . . . , Vn required for operation of constituting elements of the mobile terminal 100 by using only the main battery 191.

In this case, it can be the case that external power supplied through the external charging port 162 is charging the main battery 191. And the main battery 191 may be charging by using the cable-type battery 210. Also, the cable-type battery 210 may be charging by using the external power. The charging states described above can be the same as the cases of FIGS. 18(*b*) and (*c*).

With reference to FIG. 21(*b*), it can be known that the mobile terminal 100 can generate voltages V1, V2, . . . , Vn required for operation of the mobile terminal 100 by using only the cable-type battery 210. In this case, the remaining capacity of the main battery 191 may be little or zero. The main battery 191 may even be separated from the mobile terminal 100.

Also, with reference to FIG. 21(*c*), it can be known that the mobile terminal 100 may generate voltages V1, V2, . . . , Vn required for operation of the mobile terminal 100 by using both of the main battery 191 and the cable-type battery 210.

Figure 22:
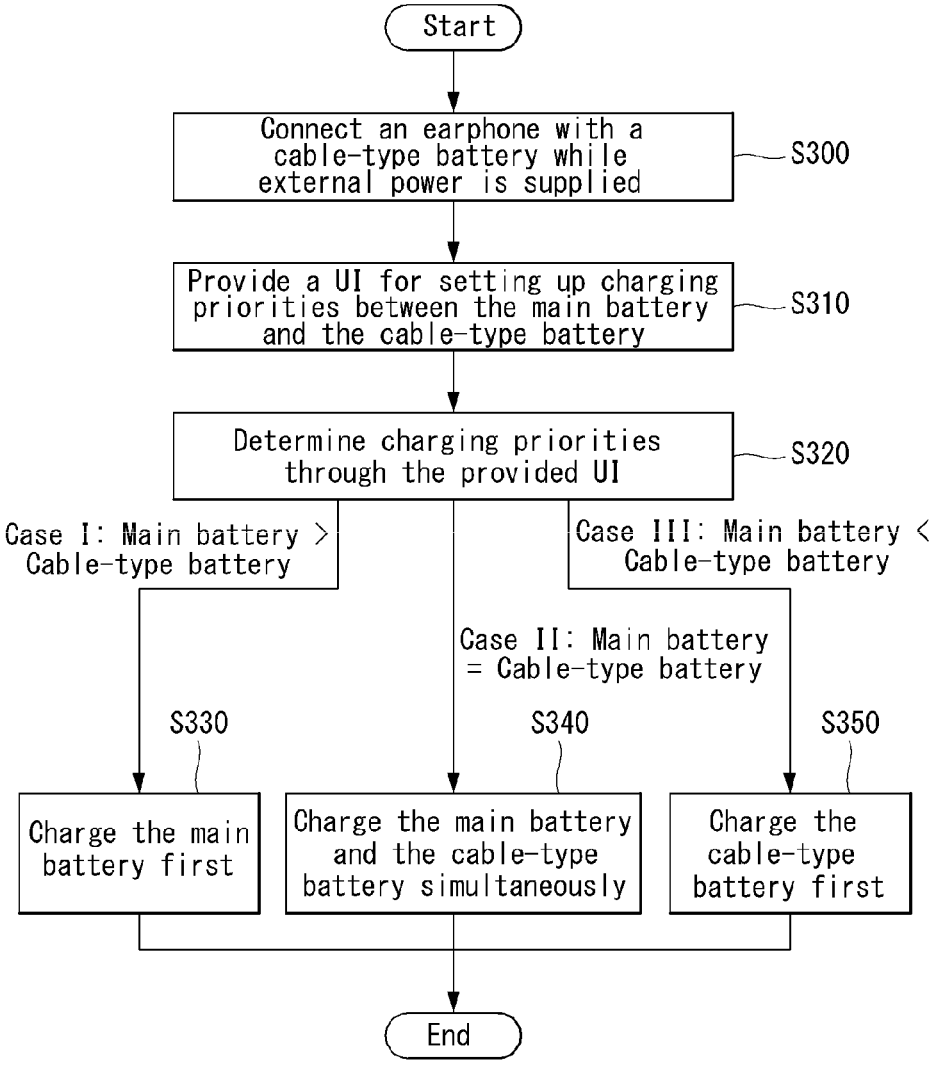
FIG. 22 is a flow diagram illustrating a yet another example of a method for operating a mobile terminal according to the present invention.

FIG. 22 is a flow diagram illustrating a yet another example of a method for operating a mobile terminal according to the present invention. In what follows, the method for operating a mobile terminal will be described with reference to related drawings.

An earphone 200 with a cable-type battery 210 is connected through the earphone port 161 while external power meant for charging is supplied through the external charging port 162, S300. Then the controller 180 provides a user interface for determining charging priorities between the main battery 191 and the cable-type battery 210 through the display unit 151.

And based on the user's operation through the user interface provided, charging priorities of the main battery 191 and the cable-type battery 210 are determined S320. Then the controller 180, according to the steps of S330 to S350, starts charging of at least one of the main battery 191 and the cable-type battery 210 according to the charging priorities determined.

In case the charging priority of the main battery 191 is the higher (Case 1) according to the priorities determined, the controller 180 charges the main battery 191 in the first place S330. In this case, if charging of the main battery 191 is completely, the controller 180 may start charging of the cable-type battery 210. And depending on situations, if the charging level of the main battery 191 reaches a predetermined level or the main battery 191 has been charged for a predetermined time period, charging of the cable-type battery 210 can be started.

In case the charging priorities of the main battery 191 and the cable-type battery 210 are the same according to the priorities determined (Case 2), the controller 180 proceeds charging of the main battery 191 and the cable-type battery 210 at the same time S340.

In case the charging priority of the cable-type battery 210 is the higher according to the priorities determined (Case 3), the controller 180 charges the cable-type battery 210 in the first place S350. In this case, if charging of the cable-type battery 210 is completed, the controller 180 may start charging of the main battery 191, This case corresponds to a situation where the remaining capacity of the main battery 191 is larger than a predetermined level. In other words, since the remaining capacity of the main battery 191 is enough, the main battery 191 may not necessarily be charged.

Meanwhile, the example of FIG. 22 can be applied similarly to an embodiment for applying charging priorities in a situation where the main battery 191 is not charged by a wireless charging method. This case assumes that the charging unit 192 can generate a charging voltage for charging a cable-type battery 210 embedded in the earphone 200 based on a wireless charging signal. Since such an extension of the application can be easily understood from the embodiment of FIG. 22 by those skilled in the art or is well-known to those skilled in the art, detailed descriptions thereof will be omitted.

Figure 23:
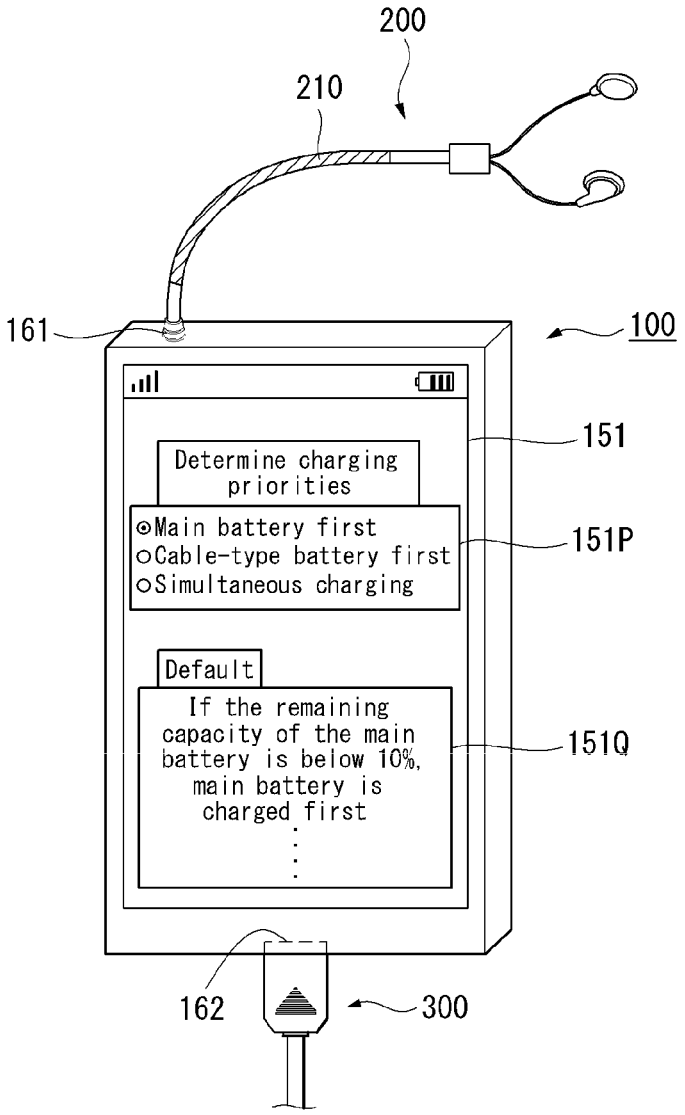
FIG. 23 is one example of a user interface for determining charging priorities of a main battery and a cable-type battery, provided through a mobile terminal according to a method for operating the mobile terminal of FIG. 22.

FIG. 23 is one example of a user interface for determining charging priorities of a main battery 191 and a cable-type battery 210, provided through a mobile terminal 100 according to a method for operating the mobile terminal 100 of FIG. 22.

With reference to FIG. 23, if an earphone with a cable-type battery 210 is connected while external power is being supplied, the controller 180 can provide a user interface 151P for determining charging priorities between the main battery 191 and the cable-type battery 210 through the display unit 151.

Also, the controller 180 can have a default setting with a higher priority than the charging priorities between the main battery 191 and the cable-type battery 210. With reference to the user interface 151Q of FIG. 23, according to a default setting, the main battery 191 is made to be charged first of all once the remaining capacity of the main battery goes below a threshold. This kind of default setting has a higher priority than the charging priorities determined by the user through the user interface 151P.

Figure 24:
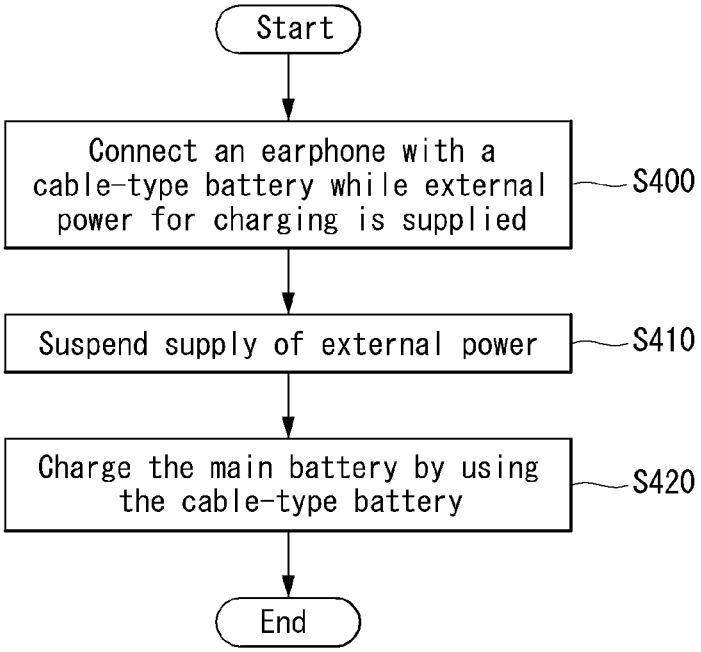
FIG. 24 is a flow diagram illustrating a still another example of a method for operating a mobile terminal according to the present invention.

FIG. 24 is a flow diagram illustrating a still another example of a method for operating a mobile terminal according to the present invention. In what follows, the method for operating a mobile terminal will be described with reference to related drawings.

An earphone 200 with a cable-type battery 210 is connected while external power for charging is supplied through a charging port 162, S400. Then, supply of the external power is suspended while the earphone 200 is still connected S410. The controller 180 charges the main battery 191 by using the cable-type battery 210, S420. In other words, power for charging the main battery 191 is replaced according as the external power is suspended.

Meanwhile, the example of FIG. 24 can be applied similarly to the embodiment where reception of a wireless charging signal is suspended while the main battery is charged wirelessly. In other words, in case the wireless charging signal is not received while the main battery 191 is charged by a wireless charging signal, the controller 180 can carry out charging of the main battery 191 by using the cable-type battery 210. Since such an extension of the application can be easily understood from the embodiment of FIG. 21 by those skilled in the art or is well-known to those skilled in the art, detailed descriptions thereof will be omitted.

Figure 25:
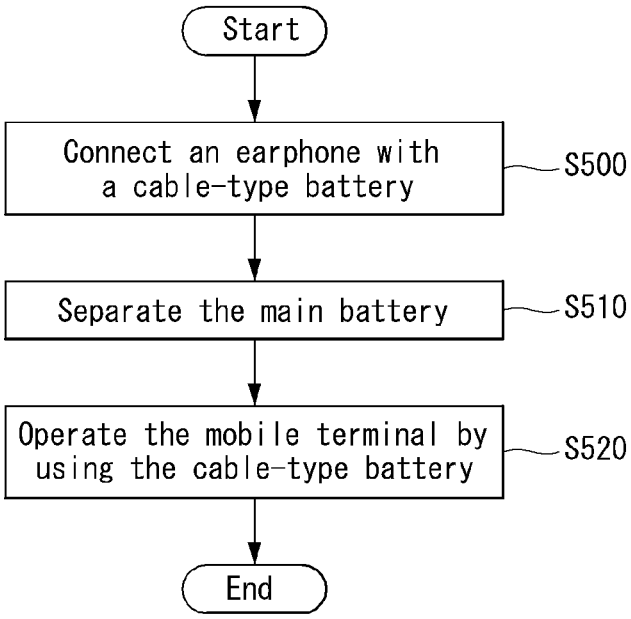
FIG. 25 is a flow diagram illustrating a further example of a method for operating a mobile terminal according to the present invention.

FIG. 25 is a flow diagram illustrating a further example of a method for operating a mobile terminal according to the present invention. In what follows, the method for operating a mobile terminal will be described with reference to related drawings.

An earphone 200 with a cable-type battery 210 is connected while external power for charging is supplied S500. Then, main battery 191 is separated from the mobile terminal 100 while the earphone 200 is still connected S510. Then the controller 180 operates the mobile terminal 100 by using the cable-type battery 210, S520. In other words, even if the main battery 191 is separated from the mobile terminal 100, the cable-type battery 210 embedded in the earphone 200 can be used as an independent power source. This can be one example of using a power source shown in FIG. 21(*b*).

Meanwhile, the example of FIG. 25 can be applied similarly to the embodiment where the main battery 191 is removed while it is charging wirelessly. In other words, in case the main battery 191 is removed from the mobile terminal 100 while the main battery 191 is charging wirelessly, the controller 180 can operate the mobile terminal 100 by using the cable-type battery 210. Since such an extension of the application can be easily understood from the embodiment of FIG. 25 by those skilled in the art or is well-known to those skilled in the art, detailed descriptions thereof will be omitted.

And according to the types of other embodiments of the present invention, the controller 180 can operate the mobile terminal 100 by using the cable-type battery 210 in case wireless charging is suspended in the middle of wireless charging or external power supplied through a charging cable is blocked. Since such an embodiment can also be easily understood from the embodiment of FIG. 22 by those skilled in the art or is well-known to those skilled in the art, detailed descriptions thereof will be omitted.

Figure 26:
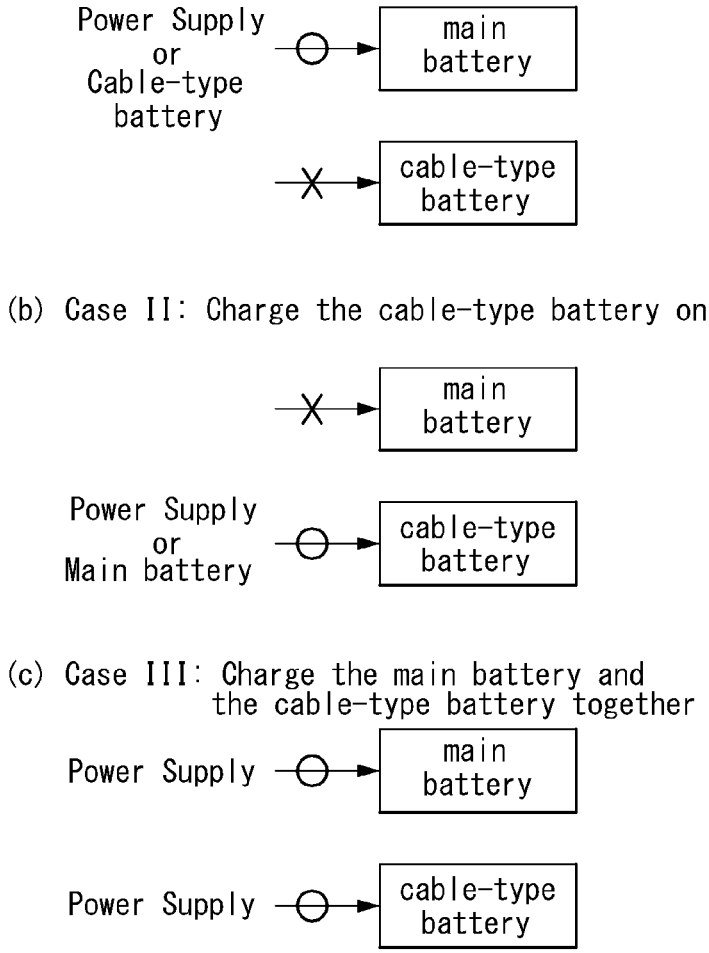
FIG. 26 illustrates examples of an instant charging state which can be applied to a mobile terminal according to the present invention.

FIG. 26 illustrates examples of an instant charging state which can be applied to a mobile terminal 100 according to the present invention.

With reference to FIG. 26(*a*), in a first charging state of the mobile terminal 100, charging may be carried out only for the main battery 191 but may not be carried out for the cable-type battery 210. At this time, a charging power source for the main battery 191 may be external power supplied through the external charging port 162 or the cable-type battery 210.

With respect to FIG. 26(*b*), in a second charging state of the mobile terminal 100, charging may be carried out only for the cable-type battery 210 but may not be carried out for the main battery 191. At this time, a charging power source for the cable-type battery 210 may be the external power or the main battery 191.

Also, with reference to FIG. 26(*c*), in a third charging state of the mobile terminal 100, charging may be carried out simultaneously for the main battery 191 and the cable-type battery 210. At this time, a charging power source for the main battery 191 and the cable-type battery 210 may be the external power.

Figure 27:
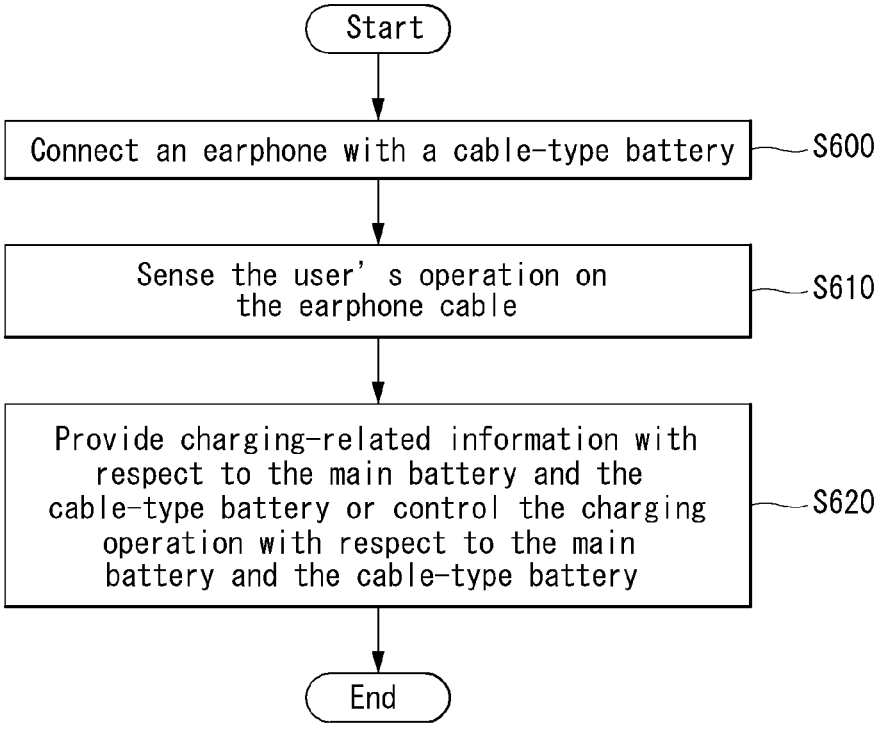
FIG. 27 is a flow diagram illustrating an additional example of a method for operating a mobile terminal according to the present invention.

FIG. 27 is a flow diagram illustrating an additional example of a method for operating a mobile terminal according to the present invention. In what follows, the method for operating a mobile terminal will be described with reference to related drawings. It should be noted that the technical principles and spirit of the embodiments of the present invention to be described below can also be applied to the inventions related to FIGS. 1 to 26 described above.

An earphone with a cable-type battery 210 is connected, S600. Next, a user's operation on the cable of the earphone 200 is sensed S610. In the cable of the earphone 200, a sensing means for sensing the user's operation or an input means may be embedded. The sensing means may include a touch sensor sensing the user's touch on the cable or a pressure sensor sensing the user's grip on the cable. However, the technical scope of the present invention is not limited to the above example.

Meanwhile, transmission of data indicating detection of the user's operation on the cable to the mobile terminal 100 can be carried out through the power terminal (P) for the case of the earphone plug of FIG. 4(*a*) and can be carried out through the microphone terminal (M) for the case of the earphone plug of FIGS. 4(*a*) and (*b*).

If the user's operation on the cable is sensed, the controller 180 outputs information related to charging of the main battery 191 and the cable-type battery 210 through the output unit 150 based on the user's operation on the cable or controls a charging operation with respect to the main battery 191 and the cable-type battery 210 S620. At this time, the main battery 191 and the cable-type battery 210 can be charged by the power received through the charging port 162 or charged based on a wireless charging signal according to a predetermined wireless charging method.

The information related to charging output through the output unit 150 can be provided visually, in the form of a sound signal, or through vibration. Meanwhile, the information related to charging of the cable-type battery 210 can include remaining capacities of the main battery 191 and the cable-type battery 210, estimated time for use of the main battery 191, and estimated time for use of the cable-type battery 210. However, the technical scope of the present invention is not limited to the example above.

Figure 28:
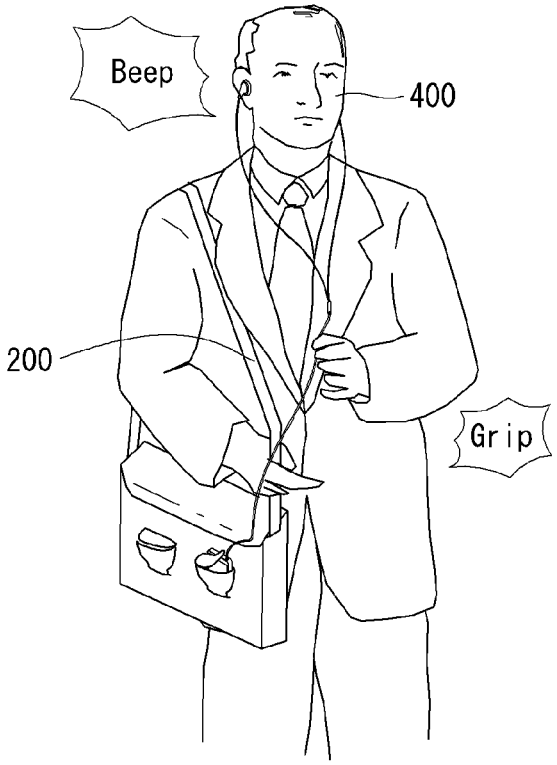

FIG. 28 is an example providing information of remaining capacity of a cable-type battery 210 embedded in an earphone 200 according to a method for operating a mobile terminal of FIG. 27.

More specifically, FIG. 28 illustrates a situation where if the user's grip on a particular part of the cable of the earphone 200, the controller 180 outputs a sound signal through the earphone 200. Length of the earphone 200 cable is mapped to the remaining capacity of the cable-type battery 210; the sound signal indicates that the remaining capacity of the cable-type battery 210 is available as much as the capacity corresponding to the particular position of the cable.

Figure 29:
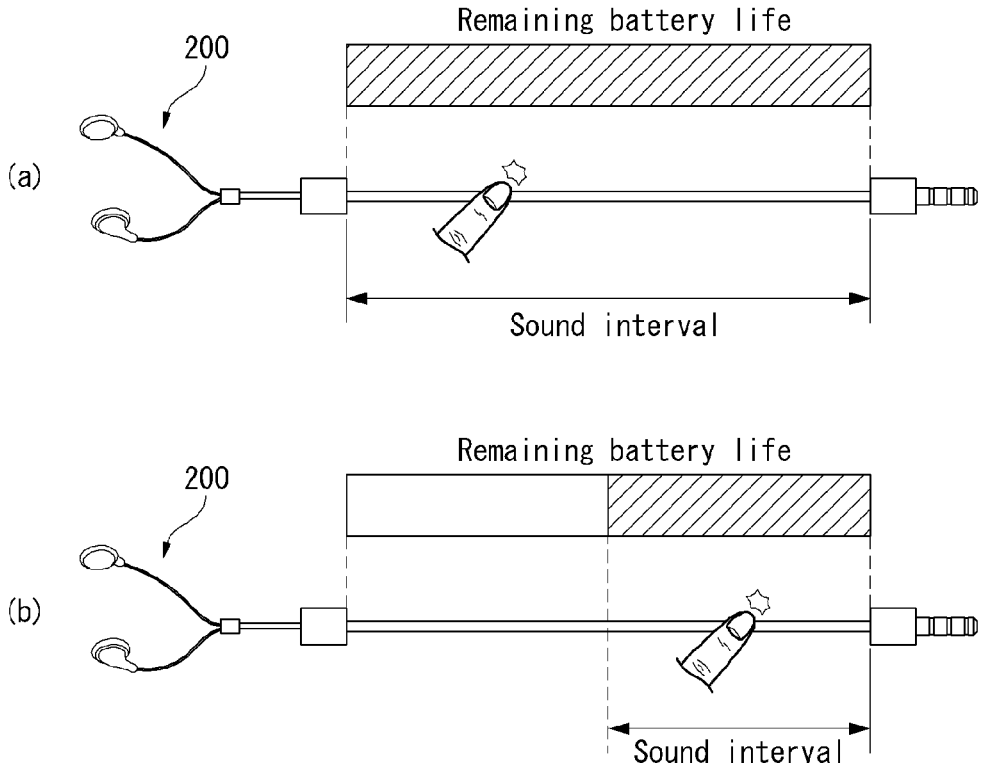
FIG. 29 illustrates a principle for providing information of remaining capacity of a cable-type battery of FIG. 28.

FIG. 29 illustrates a principle for providing information of remaining capacity of a cable-type battery 210 of FIG. 28.

With reference to FIG. 29, it can be known that the remaining capacity of the cable-type battery 210 is mapped to the length of the earphone 200 cable. In the example of FIG. 29(*a*), the remaining capacity of the cable-type battery 210 is 100%; therefore, a sound signal is output no matter what position the cable-type battery 210 is grabbed. However, in the example of FIG. 29(*b*), since the remaining capacity of the cable-type battery 210 amounts to the half of the full capacity, the sound signal is output only when the user's grip is sensed within the part of the cable corresponding to the capacity.

Meanwhile, differently from the examples of FIGS. 28 and 29, in case the user grips the cable at a particular position, the controller 180 can provide the user with information about the remaining capacity of the cable-type battery 210 by changing the type of a sound signal according to the remaining capacity of the cable-type battery 210 or varying the magnitude of the sound signal. And depending on situations, vibration may be used to inform of the remaining capacity of the cable-type battery 210.

Figure 30:
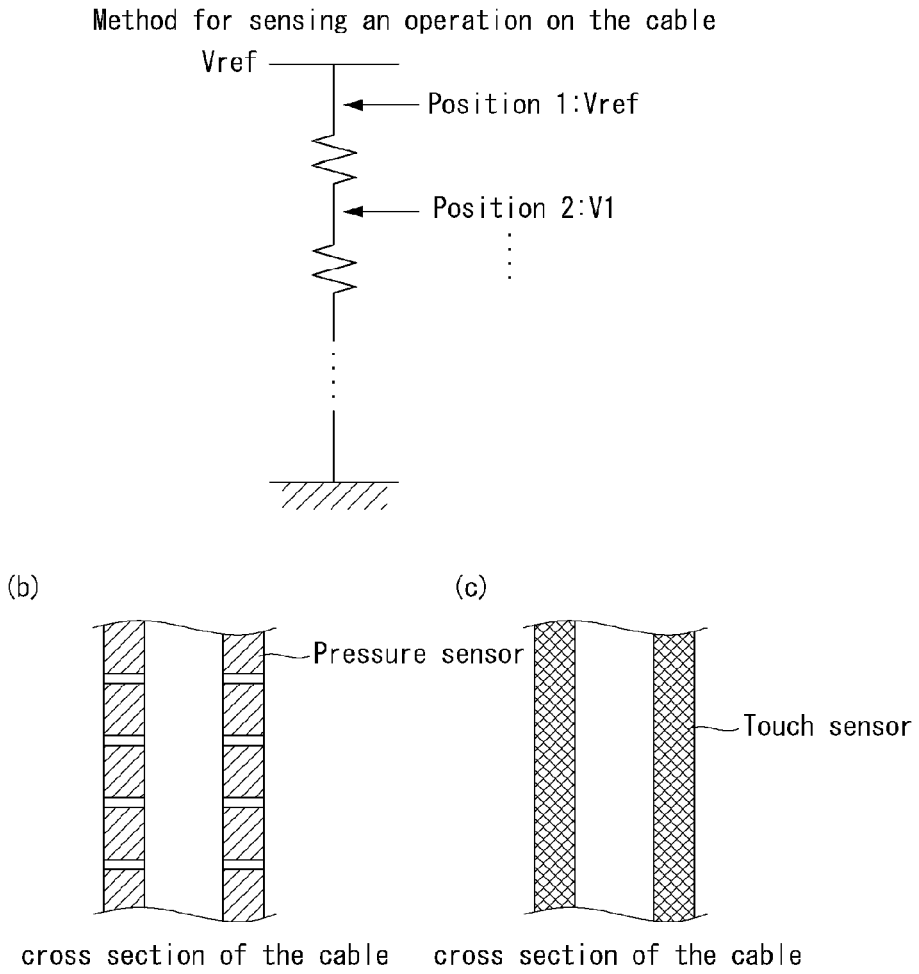
FIG. 30 provides examples illustrating a principle of sensing a user's operation on an earphone cable.

FIG. 30 provides examples illustrating a principle of sensing a user's operation on an earphone 200 cable.

With reference to FIG. 30(*a*), the earphone 200 cable can include a sensing means by which the position of the user's grip can be sensed by measuring a voltage distributed by resistance of the cable. And with reference to FIG. 30(*b*), the user's operation on the earphone 200 cable can be sensed by a plurality of pressure sensor installed on the outer side of the cable. Also, with reference to FIG. 30(*c*), the user's operation on the earphone 200 cable can be sensed by a touch sensor installed on the outer side of the cable. However, the sensing means for sensing the user's operation on the earphone 200 operation is not limited to the examples above.

Figure 31:
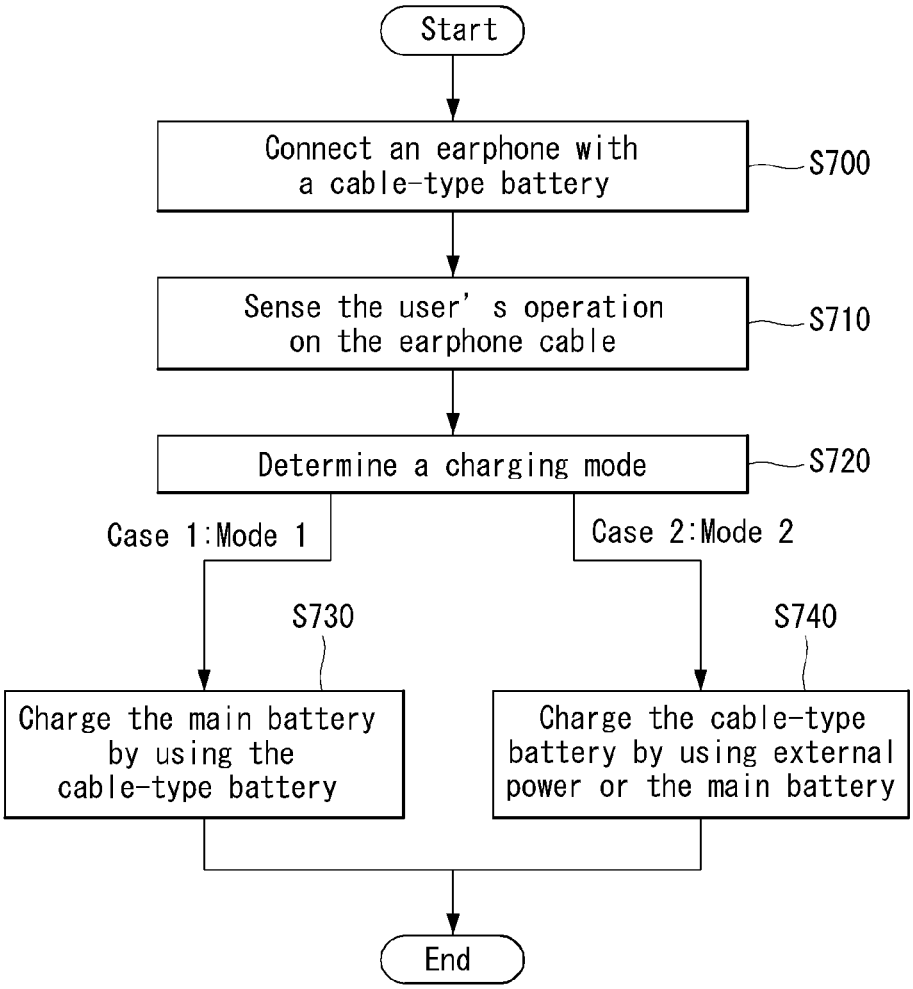
FIG. 31 is a flow diagram illustrating a still different example of a method for operating a mobile terminal according to the present invention.

FIG. 31 is a flow diagram illustrating a still different example of a method for operating a mobile terminal according to the present invention. In what follows, the method for operating a mobile terminal will be described with reference to related drawings.

An earphone 200 with a cable-type battery 210 is connected to the mobile terminal 100, S700. The earphone 200 cable has a sensing means by which the user's operation on the cable can be sensed. While the earphone 200 is connected, the sensing means senses the user's operation on the earphone 200 cable S710.

Then the controller 180 can determine a charging mode of the mobile terminal 100 based on the user's operation on the cable S720. The charging mode of the mobile terminal 100 can be determined by the position, direction, speed, and distance of the user's operation.

In case the determined mode is a first mode, the controller 180 charges the main battery 191 by using the cable-type battery 210, S730. And in case the determined mode is a second mode, the controller 180 charges the cable-type battery 210 by using external power or the main battery 191 S740. Meanwhile, the charging mode of the mobile terminal 100 determined based on the user's operation on the cable is not limited to the aforementioned first and second mode. For example, the mobile terminal 100 can have an additional charging mode where at least one of the main battery 191 and the cable-type battery 210 can be charged based on a wireless charging signal.

Figure 32:
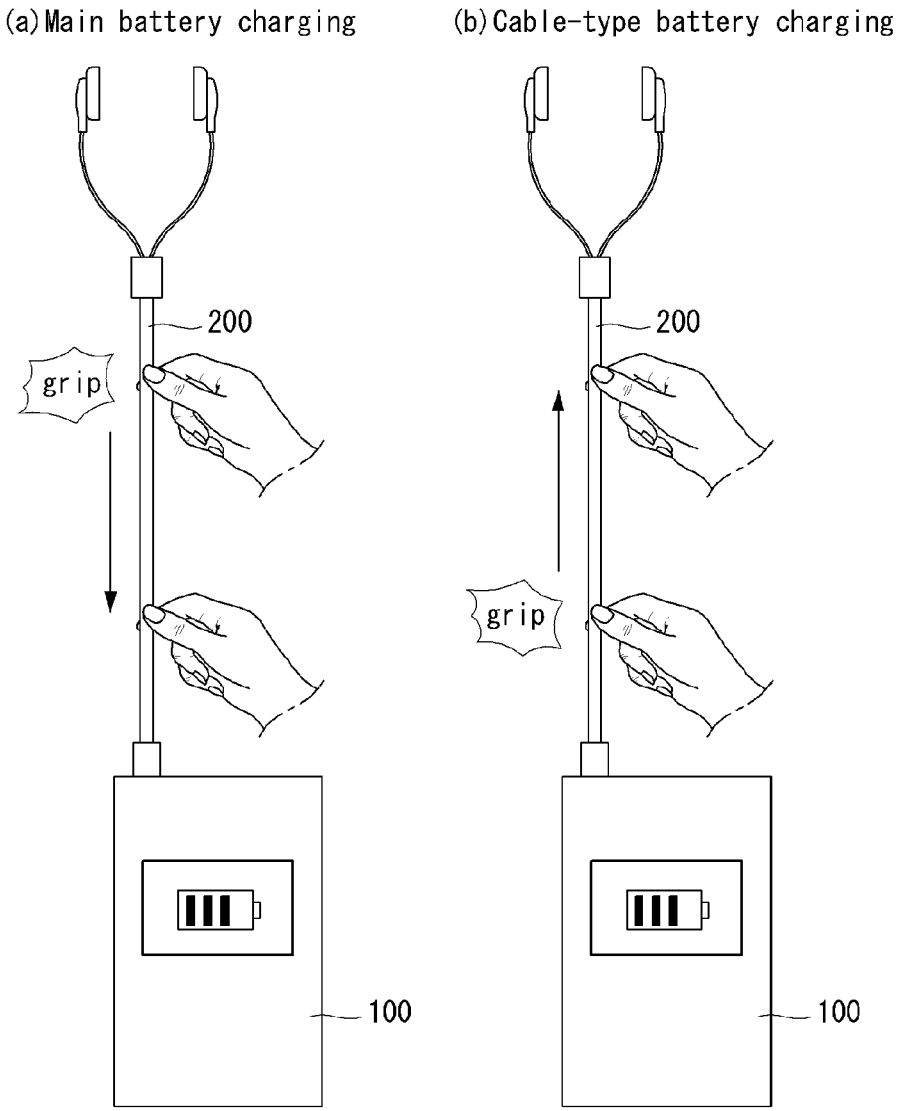
FIG. 32 illustrates examples of a charging mode of a mobile terminal carried out according to the method for operating a mobile terminal of FIG. 31.

FIG. 32 illustrates examples of a charging mode of a mobile terminal 100 carried out according to the method for operating a mobile terminal of FIG. 31.

FIG. 32(*a*) illustrates a situation where the user moves a touch input on the earphone 200 cable (or position of the grip) toward the mobile terminal 100 and the controller 180 charges the main battery 191 by using a cable-type battery 210 embedded in the earphone 200.

FIG. 32(*b*) illustrate a situation where the user moves a touch input on the earphone 200 cable (or position of the grip) away from the mobile terminal 100 and the controller 180 charges the cable-type battery 210 embedded in the earphone 200 by using external power or the main battery 191. Meanwhile, in case the operation as shown in FIG. 29(*b*) is sensed, the controller 180 may charge the main battery 191 based on a wireless charging signal.

As described above, the mobile terminal 100 according to the present invention can determine a charging method with respect to the main battery 191 and the cable-type battery 210 carried out in the mobile terminal 100 based on a direction of the user's operation on the earphone 200 cable.

Figure 33:
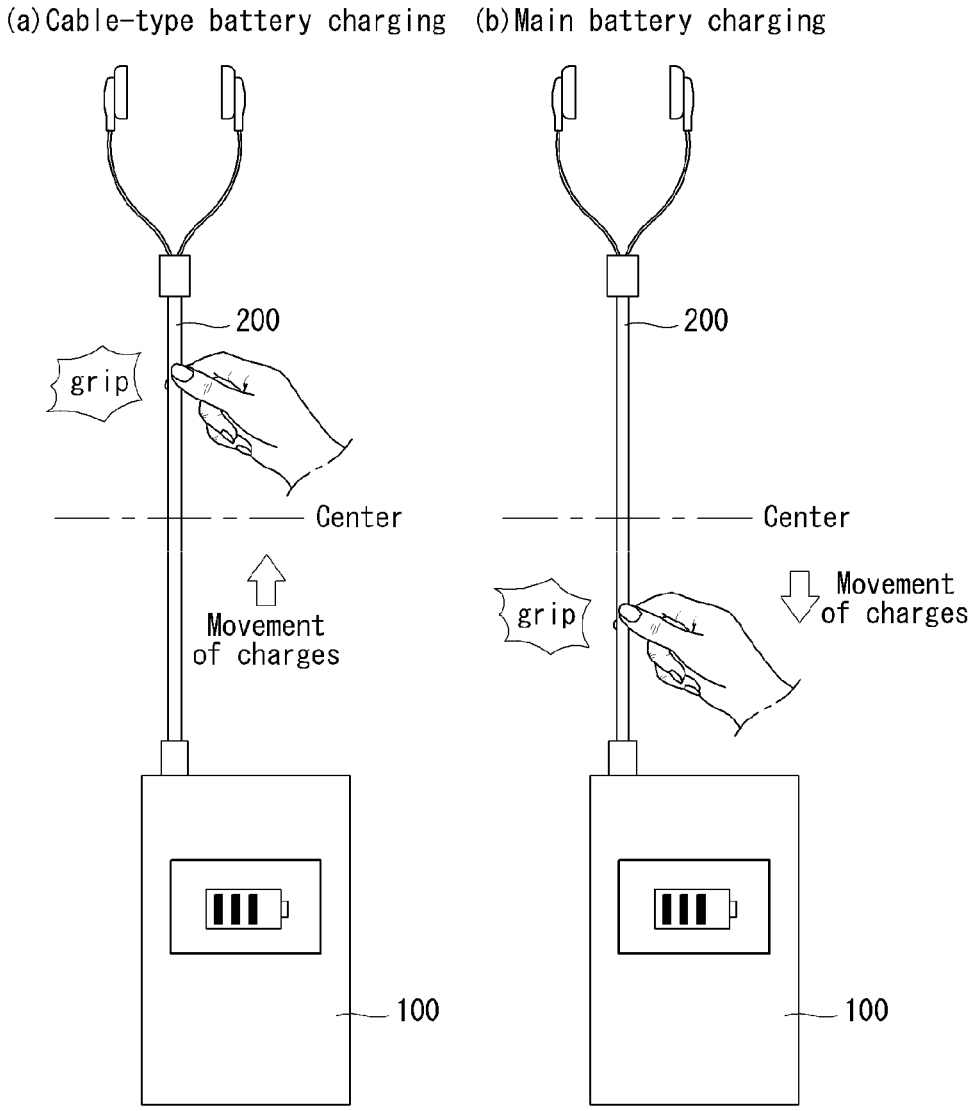
FIG. 33 illustrates different examples of a charging mode of the mobile terminal carried out according to the method for operating a mobile terminal of FIG. 31.

FIG. 33 illustrates different examples of a charging mode of the mobile terminal 100 carried out according to the method for operating a mobile terminal of FIG. 31.

With reference to FIG. 33(*a*), in case the user grips a upper part of the earphone 200 cable, the controller 180 charges the cable-type battery 210 embedded in the earphone 200 by using external power or the main battery 191.

FIG. 33(*b*) illustrates a situation where the user grips a lower part of the earphone 200 cable and the controller 180 charges the main battery 191 by using the cable-type battery 210 embedded in the earphone 200. Meanwhile, in case the user's operation such as shown in FIG. 33(*b*) is sensed, the controller 180 can charge the main battery 191 based on a wireless charging signal.

As described above, the mobile terminal 100 according to the present invention can determine a charging method for the main battery 191 and the cable-type battery 210 carried out in the mobile terminal 100 based on the position of the user's operation on the earphone 200 cable.

Figure 34:
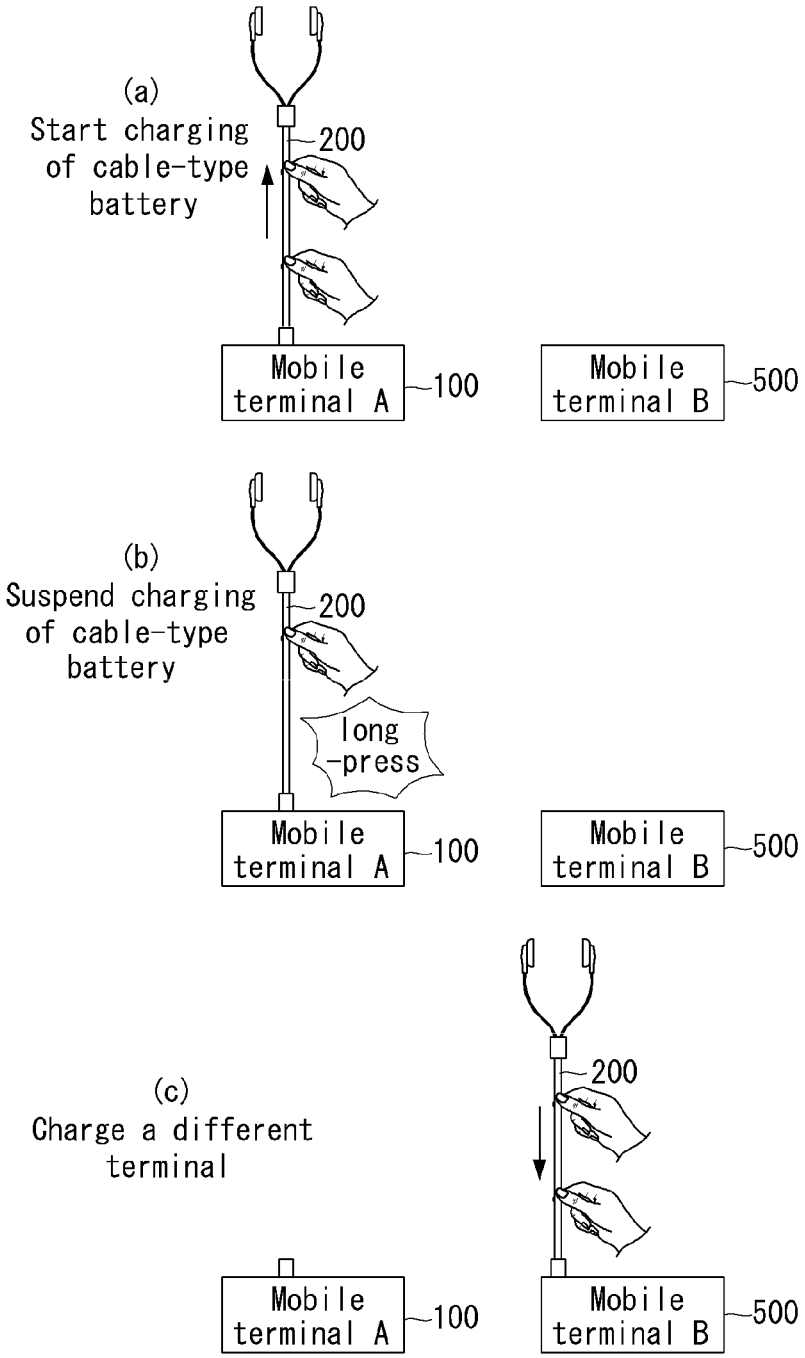
FIG. 34 illustrates an example of sharing battery power between mobile terminals by using an earphone with a cable-type battery.

FIG. 34 illustrates an example of sharing battery power between mobile terminals (100 and 500) by using an earphone with a cable-type battery 210.

FIG. 34(*a*) illustrates a situation where the user operates the earphone 200 cable in a direction away from the mobile terminal 100 according to the present invention while the cable-type battery 210 embedded in the earphone 200 is connected to the mobile terminal 100. Then the mobile terminal 100 charges the cable-type battery 210 with charges stored in the main battery 191.

FIG. 34(*b*) illustrates a situation where the user grips the cable for more than a predetermined time period so that charging of the cable-type battery 210 by using the main battery 191 is suspended. Next, the user separates the earphone 200 from the mobile terminal 100 and connects the earphone 200 to a different mobile terminal 500.

While the earphone 200 is connected to the different mobile terminal 500, as shown in FIG. 31(*c*), the user carries out operation on the direction of the mobile terminal 100 with respect to the earphone 200 cable. Then the main battery of the different mobile terminal 500 is charged by the cable-type battery 210 embedded in the earphone 200.

Meanwhile, differently from the example of FIG. 34, charges charging the cable-type battery 210 may originate from the external power supplied through the charging port 162 or from a wireless charging signal.

Figure 35:
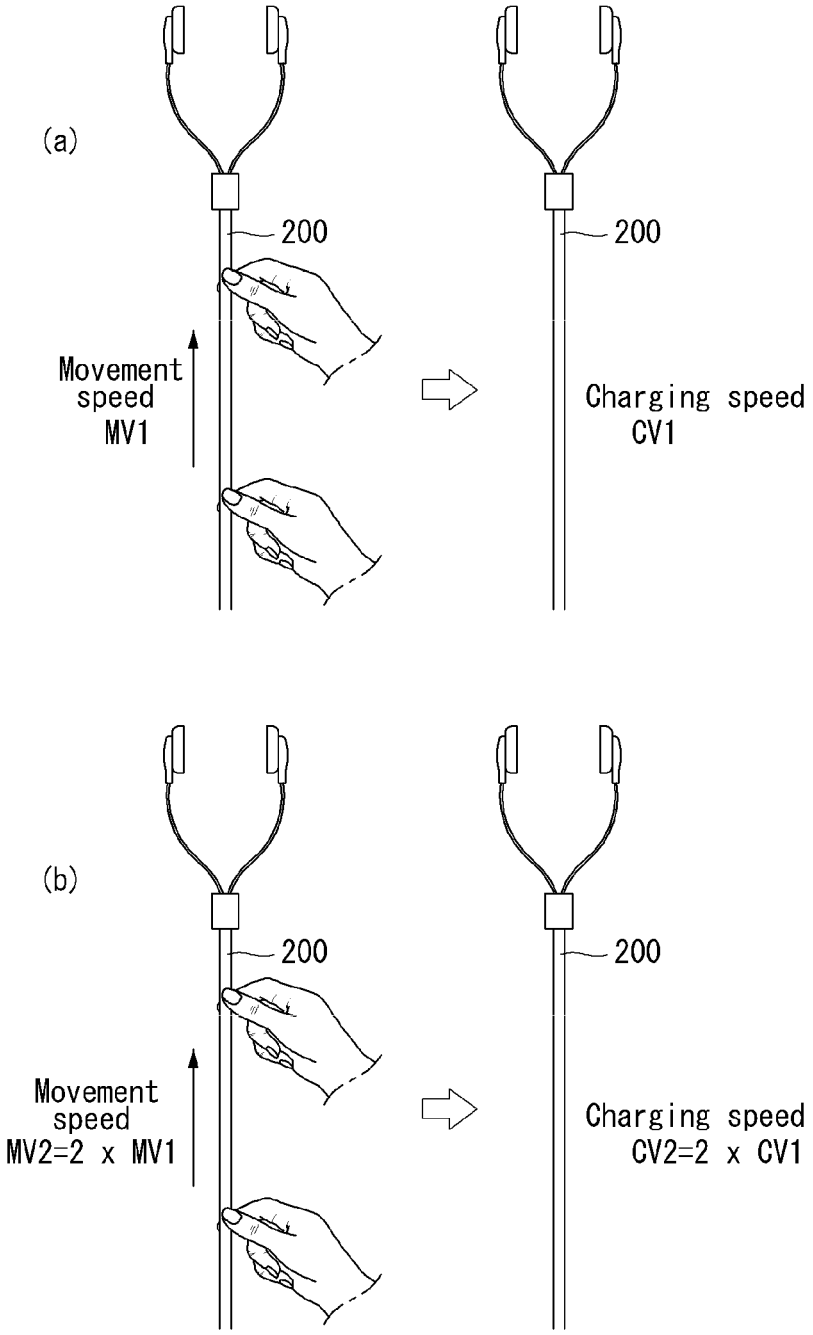
FIG. 35 illustrates an example of controlling a speed of charging carried out in a mobile terminal according to the present invention based on a speed of operation on an earphone cable.

FIG. 35 illustrates an example of controlling a speed of charging carried out in a mobile terminal 100 according to the present invention based on a speed of operation on an earphone 200 cable.

FIG. 35(*a*) illustrates a situation where the user performs an operation on the cable with a moving speed of MV1 and the mobile terminal 100 charges the cable-type battery 210 by using the main battery 191 with a charging speed CV1.

FIG. 35(*b*) illustrates a situation where the user performs an operation on the cable with a moving speed of MV2 which is double the MV1 and the mobile terminal 100 charges the cable-type battery 210 by using the main battery 191 with a charging speed CV2 which is the double the CV1.

In other words, the mobile terminal 100 according to the present invention can control the speed of charging carried out in the mobile terminal 100 based on the speed of the user's operation on the earphone 200.

Figure 36:
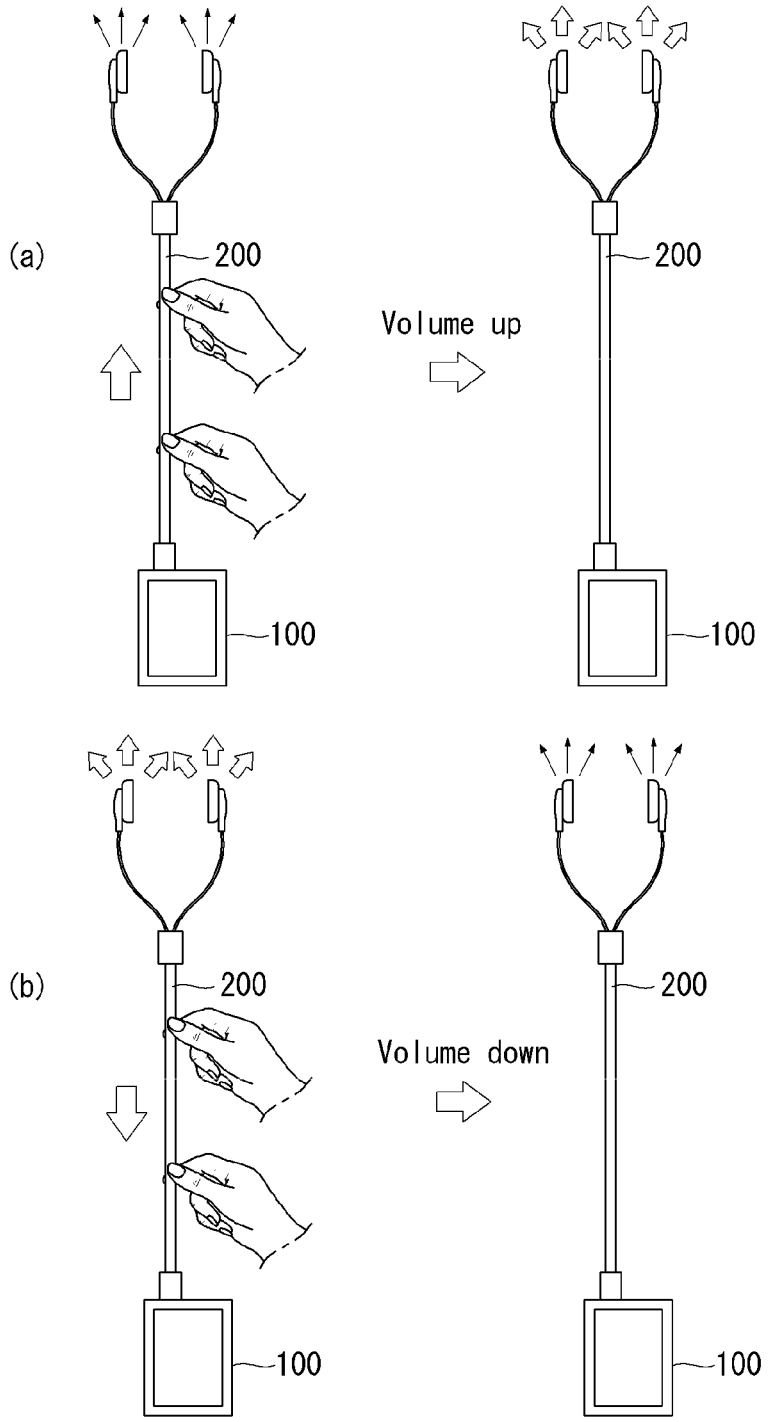
FIG. 36 illustrates examples of controlling an operation state of the mobile terminal based on an operation on an earphone cable connected to the mobile terminal.

FIG. 36 illustrates examples of controlling an operation state of the mobile terminal 100 based on an operation on an earphone 200 cable connected to the mobile terminal 100.

FIG. 36(*a*) illustrates a situation where the user operates the earphone 200 cable in a direction away from the mobile terminal 100 and the controller 180 increases the volume of a sound signal output through the earphone 200. And the FIG. 36(*b*) illustrates a situation where the user operates the earphone 200 cable toward the mobile terminal 100 and the controller 180 reduces the volume of a sound signal output through the earphone 200.

Meanwhile, the operation state of the mobile terminal 100, which can be controlled based on a direction of the operation with respect to the cable, can include screen brightness, strength of vibration, screen scroll, and page transition as well as the sound volume. However, the technical scope of the present invention is not limited to the above example.

Figure 37:
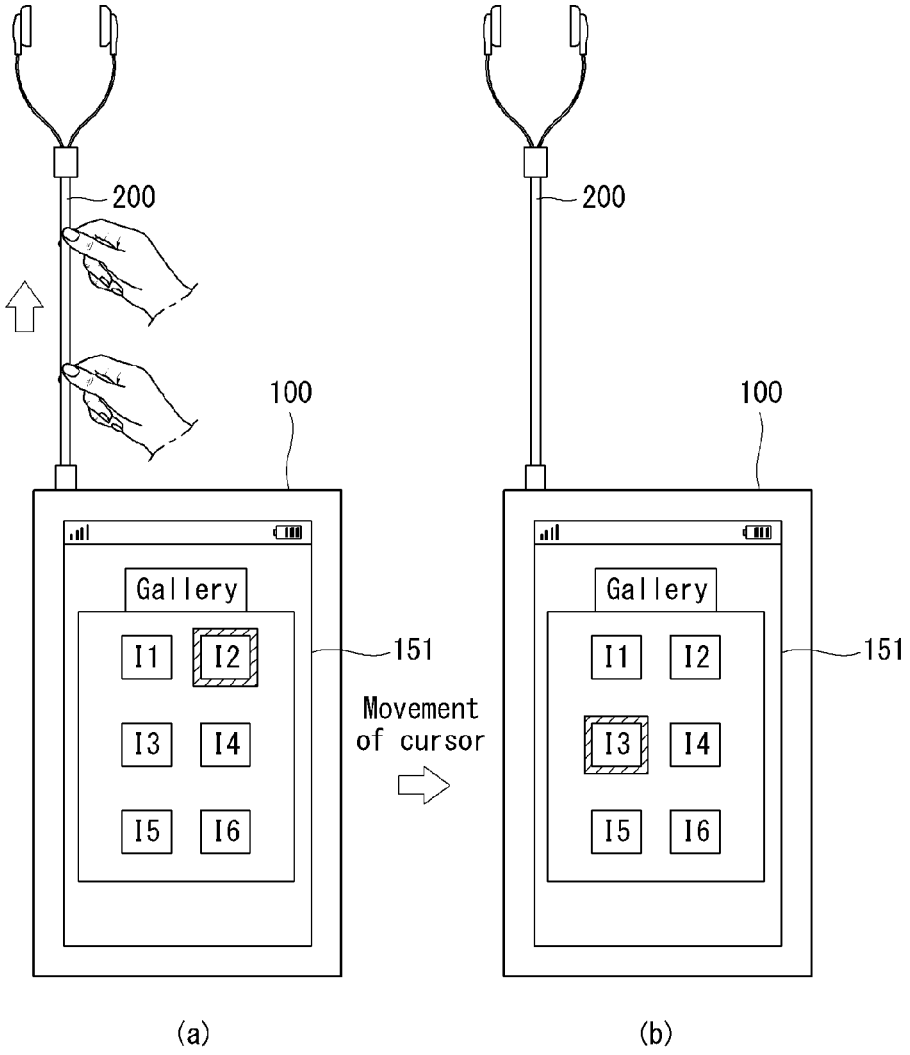
FIG. 37 illustrates another example of controlling an execution state of an application under execution in the mobile terminal based on an operation on an earphone cable connected to the mobile terminal.

FIG. 37 illustrates another example of controlling an execution state of an application under execution in the mobile terminal 100 based on an operation on an earphone 200 cable connected to the mobile terminal 100.

FIG. 37(*a*) illustrates a situation where a particular image 12 is selected from an execution screen of a gallery application and the user operates the earphone 200 cable in a direction away from the mobile terminal 100. Then the controller 180, as shown in FIG. 37(*b*), can change the image selected from the execution screen of the gallery application from the particular image 12 to a different image 13. As a result, a cursor moves from the particular image 12 to the different image 13.

In other words, the mobile terminal 100 according to the present invention can control the execution state of an application under execution based on the operation on the earphone 200 cable. Meanwhile, the mobile terminal 100 can control the unique function of the application under execution based on the operation on the cable and carry out a simple operation such as screen scroll and screen transition. However, the technical scope of the present invention is not limited to the examples above.

Figure 38:
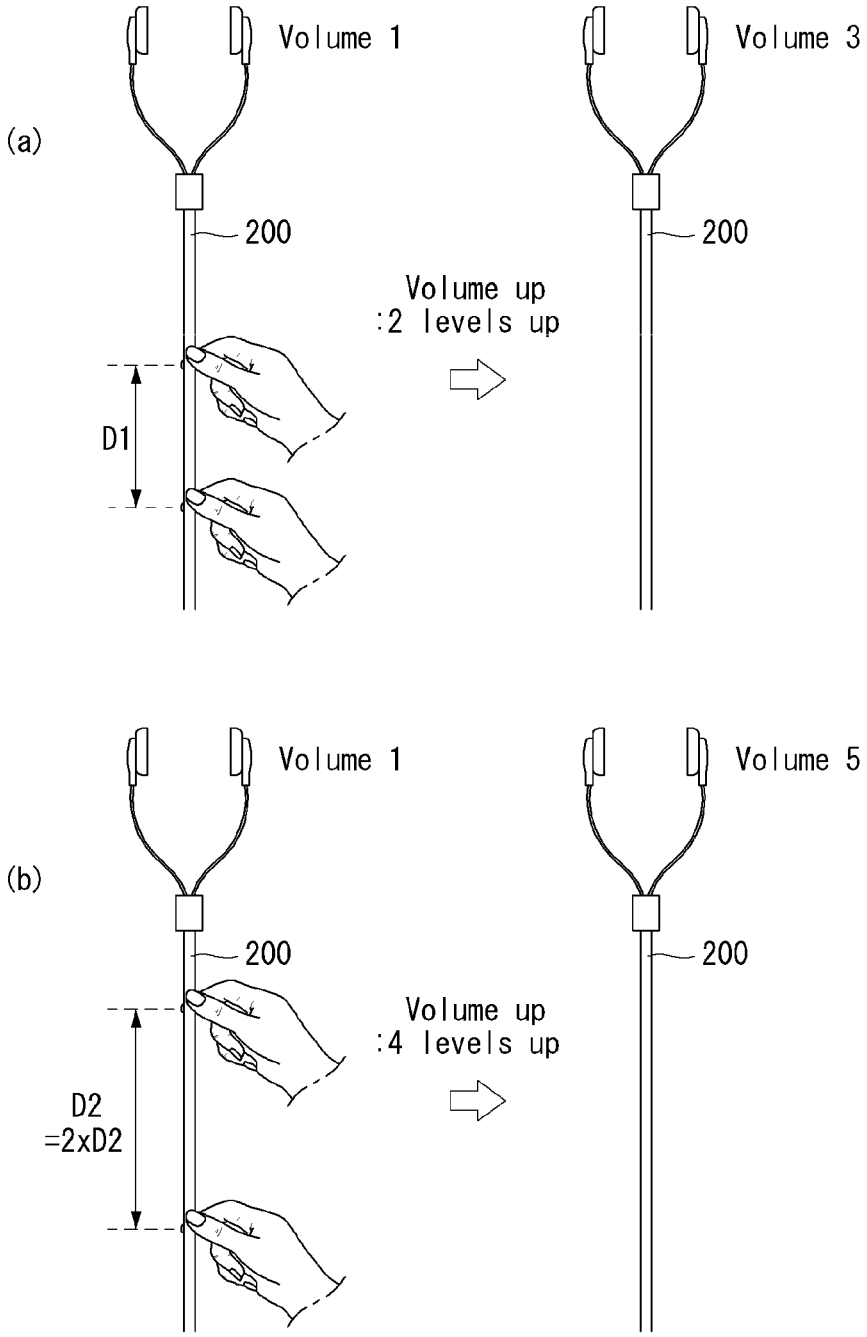
FIG. 38 illustrates other examples of controlling an operation state of the mobile terminal based on an operation of an earphone cable connected to the mobile terminal.

FIG. 38 illustrates other examples of controlling an operation state of the mobile terminal 100 based on an operation of an earphone 200 cable connected to the mobile terminal 100.

FIG. 38(*a*) illustrates a situation where the earphone 200 is connected to the mobile terminal 100 and the user moves a touch input on the earphone 200 cable away from the mobile terminal 100 by a distance D1 and the mobile terminal 100 increases the level of a sound signal by 2.

FIG. 38(*b*) illustrates a situation where the earphone 200 is connected to the mobile terminal 100 and the user moves a touch input on the earphone 200 cable away from the mobile terminal 100 by D2 which is double the value of D1 and the mobile terminal 100 increases the level of a sound single by 4, which is double the level of the increased sound signal of FIG. 38(*a*).

In other words, the mobile terminal 100 according to the present invention can control the operation state of the mobile terminal 100 by reflecting an operation distance with respect to the cable of the earphone 200 connected to the mobile terminal 100. Meanwhile, the mobile terminal 100 can control the speed of charging carried out in the mobile terminal 100 by reflecting an operation distance with respect to the cable of the earphone 200 connected to the mobile terminal 100.

Figure 39:
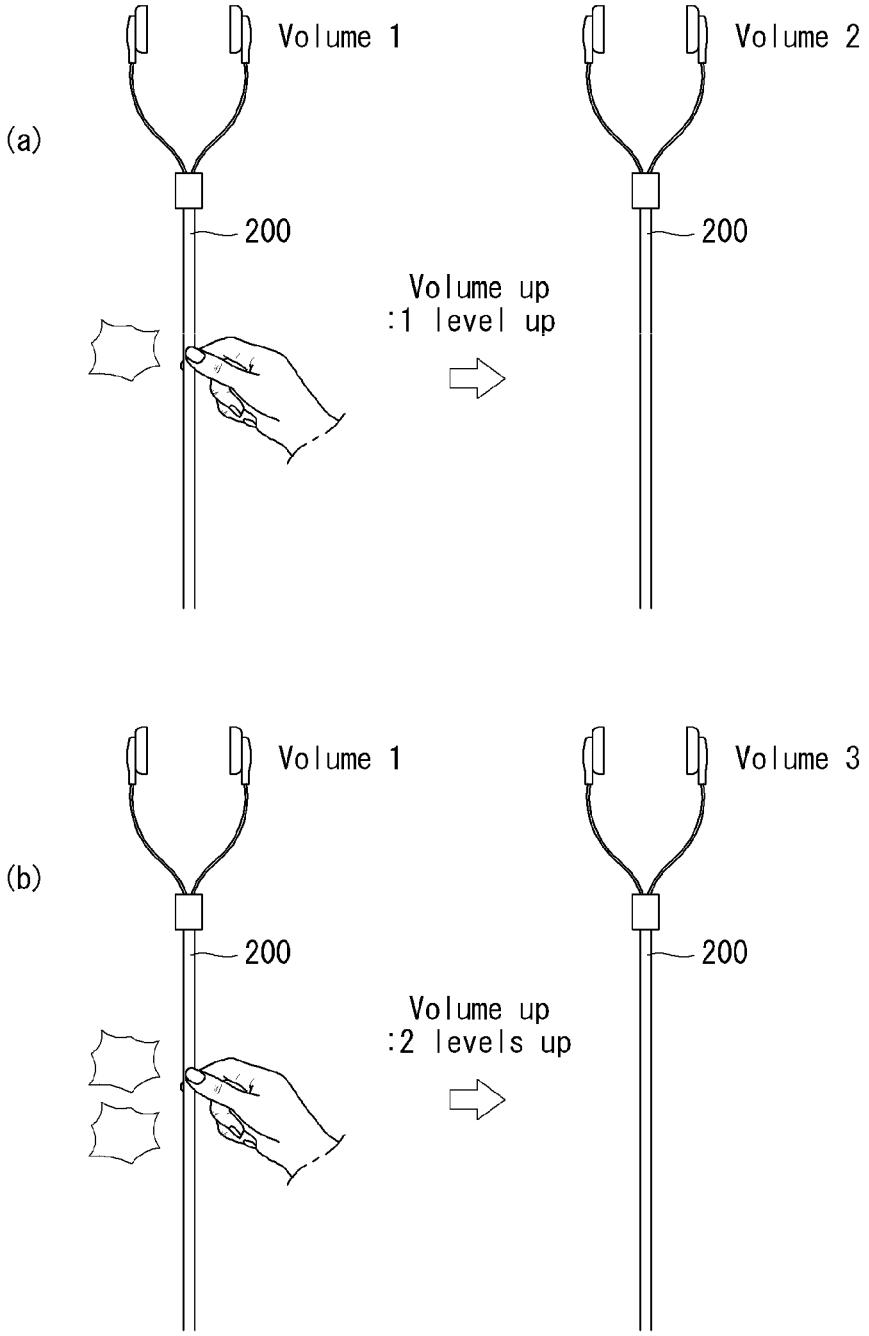
FIG. 39 illustrates additional examples of controlling an operation state of the mobile terminal based on an operation of an earphone cable connected to the mobile terminal.

FIG. 39 illustrates additional examples of controlling an operation state of the mobile terminal 100 based on an operation of an earphone 200 cable connected to the mobile terminal 100.

FIG. 39(*a*) illustrates a situation where the earphone 200 is connected to the mobile terminal 100 and the user grips the earphone 200 cable once and the mobile terminal 100 increases the level of a sound signal by 1.

FIG. 39(*b*) illustrates a situation where the earphone 200 is connected to the mobile terminal 100 and the user grips the earphone 200 cable twice and the mobile terminal 100 increases the level of a sound signal by 4.

In other words, the mobile terminal 100 according to the present invention can control the operation state of the mobile terminal 100 by reflecting the number of operations on the cable of the earphone 200 connected to the mobile terminal 100. Meanwhile, the mobile terminal 100 according to the present invention can control the speed of charging carried in the mobile terminal 100 by reflecting the number of operations on the cable of the earphone 200 connected to the mobile terminal 100.

The methods for operating a mobile terminal according to the present invention can be implemented using a computer-readable codes in a recording medium in which a program for carrying out the operation methods are recorded. Computer-readable media includes all kinds of recording devices which stores data that can be read by a computer system. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). Also, the computer may include the controller 180 of the mobile terminal. Therefore, the detailed descriptions of the foregoing embodiments should not to be interpreted to limit the technical scope of the present invention but should be regarded as illustrative. The technical scope of the present invention should be determined by reasonable interpretation of the appended claims and all changes and modifications that fall within the equivalents of the technical scope of the present invention should be understood to be embraced by the appended claims.

The following describe advantageous effects of a mobile terminal according to the present invention.

According to one embodiment of the present invention, an embedded main battery can be charged by using an earphone with a cable-type battery or can charge a cable-type battery of the earphone by using the main battery of external power.

According to another embodiment of the present invention, information related to charging a main battery or a cable-type battery can be provided or a charging operation can be controlled based on a user's operation with respect to an earphone cable with a cable-type battery.

What is claimed is:

1. A mobile terminal, comprising:

a power supply unit including a rechargeable main battery;

an earphone port; and a controller determining whether an earphone with a cable-type battery is connected through the earphone port and external power for charging the rechargeable main battery or the cable-type battery is supplied, controlling the power supply unit to charge the rechargeable main battery by using the external power if it is determined that the external power is being supplied, and controlling the power supply unit to charge the rechargeable main battery by using the cable-type battery embedded in the earphone if it is determined that the earphone is connected through the earphone port while the external power is not supplied, wherein, if it is determined that the external power is being supplied at the time the earphone is connected, the controller controls the power supply unit to charge the cable-type battery by using the external power.

2. The mobile terminal of claim 1, wherein the external power is supplied through a charging cable connected to a charging port or supplied from the outside according to a predetermined wireless charging method.

3. The mobile terminal of claim 2, wherein, in case the external power is not supplied at the time the earphone is connected, the controller determines whether to charge the rechargeable main battery by using the cable-type battery by taking account of the remaining battery life.

4. The mobile terminal of claim 2, wherein, in case it is determined that the external power is not supplied at the time the earphone is connected and a predetermined condition is met, the controller controls the power supply unit to operate the mobile terminal by using the cable-type battery as a power source rather than using the cable-type battery to charge the rechargeable main battery.

5. The mobile terminal of claim 2, wherein, in case supply of external power through the external charging port is suspended after the earphone is connected, the controller controls the power supply unit to charge the rechargeable main battery by using the cable-type battery.

6. The mobile terminal of claim 2, wherein, in case the rechargeable main battery is removed from the mobile terminal after the earphone is connected, the controller controls the power supply unit to operate the mobile terminal by using the cable-type battery as a power source.

7. The mobile terminal of claim 1, wherein the controller determines charging priorities of the rechargeable main battery and the cable-type battery and controls the power supply unit to charge the rechargeable main battery and the cable-type battery according to the priorities determined.

8. The mobile terminal of claim 1, further comprising a display unit, where the controller displays on the display unit a graphic user interface meant for setting up charging priorities of the rechargeable main battery and the cable-type battery if it is determined that the external power is being supplied at the time the earphone is connected and controls the power supply unit to charge the rechargeable main battery and the cable-type battery according to the priorities set up through the graphic user interface.

* * * * *